US011051563B2

(12) United States Patent
Kittaka et al.

(10) Patent No.: US 11,051,563 B2
(45) Date of Patent: Jul. 6, 2021

(54) AIR COOLING BLOWER AND AIR-COOLED CLOTHING ON WHICH AIR COOLING BLOWER IS MOUNTED

(71) Applicant: SUN-S Co., Ltd., Fukuyama (JP)

(72) Inventors: Kaoru Kittaka, Fukuyama (JP); Keiji Tanaka, Fukuyama (JP); Tsuyoshi Nakamura, Fukuyama (JP)

(73) Assignee: SUN-S Co., Ltd., Fukuyama (JP)

( * ) Notice: Subject to any disclaimer, the term of this patent is extended or adjusted under 35 U.S.C. 154(b) by 499 days.

(21) Appl. No.: 15/566,364

(22) PCT Filed: Jun. 19, 2017

(86) PCT No.: PCT/JP2017/022467
§ 371 (c)(1),
(2) Date: Oct. 13, 2017

(87) PCT Pub. No.: WO2018/012204
PCT Pub. Date: Jan. 18, 2018

(65) Prior Publication Data

US 2018/0295901 A1 Oct. 18, 2018

(30) Foreign Application Priority Data

Jul. 12, 2016 (JP) ..... JP2016-137868

(51) Int. Cl.
*A41D 13/002* (2006.01)
*F04D 25/12* (2006.01)
(Continued)

(52) U.S. Cl.
CPC ..... *A41D 13/0025* (2013.01); *A41D 3/00* (2013.01); *F04D 25/08* (2013.01); *F04D 25/084* (2013.01);
(Continued)

(58) Field of Classification Search
CPC combination set(s) only.
See application file for complete search history.

(56) References Cited

U.S. PATENT DOCUMENTS 3,535,707 A * 10/1970 Greenlee ..... A61F 9/068
128/200.27
3,925,851 A * 12/1975 Bevans ..... F16L 33/035
24/20 TT
(Continued)

FOREIGN PATENT DOCUMENTS

CN 203646537 U 6/2014
JP 5672642 B1 2/2015
(Continued)

OTHER PUBLICATIONS

Office Action dated Mar. 5, 2019 by the State Intellectual Property Office of the People's Republic of China in counterpart Chinese Patent Application No. 201780001053.7 (12 pages including translation).

*Primary Examiner* — Steven B McAllister
*Assistant Examiner* — Elizabeth M. May
(74) *Attorney, Agent, or Firm* — Sughrue Mion, PLLC

(57) ABSTRACT

The present invention relates to an air cooling blower and a piece of air-cooled clothing on which the air cooling blower is mounted. An air intake port is provided on a first end side of a tubular fan case, and an air outlet is provided on a second end side. First lock portions are provided in portions of a mounting flange or in portions of the tubular fan case near the portions of the mounting flange, and a second lock portion is provided in a portion of the mounting flange that opposes the first lock portions via a central axis of the tubular fan case interposed therebetween or in a portion of the tubular fan case near the portion of the mounting flange
(Continued)

that opposes the first lock portions via the central axis of the tubular fan case interposed therebetween.

12 Claims, 21 Drawing Sheets

(51) Int. Cl.

| | |
|---|---|
| ***F04D 25/08*** | (2006.01) |
| ***F04D 29/60*** | (2006.01) |
| ***A41D 3/00*** | (2006.01) |
| ***F04D 29/64*** | (2006.01) |
| ***F04D 29/52*** | (2006.01) |

(52) U.S. Cl.
CPC ..... *F04D 25/12* (2013.01); *F04D 29/601* (2013.01); *F04D 29/646* (2013.01); *F04D 29/522* (2013.01)

(56) References Cited

U.S. PATENT DOCUMENTS 5,967,763 A * 10/1999 Horng ..... F04D 25/08
310/68 R
2003/0234627 A1* 12/2003 Reinhold ..... G05F 1/66
318/434

FOREIGN PATENT DOCUMENTS

JP 2015-065998 A 4/2015
WO 2007/061088 A1 5/2007

* cited by examiner

AIR COOLING BLOWER AND AIR-COOLED CLOTHING ON WHICH AIR COOLING BLOWER IS MOUNTED

CROSS REFERENCE TO RELATED APPLICATIONS

This application is a National Stage of International Application No. PCT/JP2017/022467 filed Jun. 19, 2017 (claiming priority based on Japanese Patent Application No. 2016-137868 filed Jul. 12, 2016), the contents of which are incorporated herein by reference in their entirety.

TECHNICAL FIELD

The present invention relates to an air cooling blower and a piece of air-cooled clothing on which the air cooling blower is mounted.

BACKGROUND ART

For example, a piece of air-cooled clothing that is worn when performing work and activities in a place with high ambient temperature has been proposed and has attracted much attention. Such a piece of air-cooled clothing is configured to mount an air cooling blower in a portion of a round-shaped through hole, for example. Specifically, such an air cooling blower is configured to include a tubular fan case having an air intake port on a first end side and an air outlet port on an outer peripheral portion, a fan provided inside the tubular fan case, a motor that drives the fan, a mounting flange that is formed to protrude in an outer peripheral direction in a portion of an outer peripheral wall of the tubular fan case on the first end side, and a mounting ring that engages with the mounting flange at the outer peripheral portion of the tubular fan case (there is a similar configuration to the above in Patent Literature 1 described below, for example).

CITATION LIST

Patent Literature

PTL 1: Japanese Patent No. 5672642

SUMMARY OF INVENTION

Technical Problem

In the conventional art described above, air-conditioning clothing needed to be washed after, for example, work and an activity, is configured so that the air cooling blower is attachable and detachable to and from the portion of the through hole. Specifically, when the air cooling blower is mounted on the air-cooled clothing, first, a tubular fan case of the air cooling blower is inserted into a portion of a round-shaped through hole, for example, formed in the air-cooled clothing from the front side towards the back side of the air-cooled clothing. Subsequently, a mounting ring is, at the back side of the air-cooled clothing, moved towards the first end side of the tubular fan case from a second end side of the tubular fan case of the air cooling blower. Subsequently, an engagement portion of the mounting ring is engaged to a lock portion of the mounting flange. In the above state, an edge of the through hole of the air-cooled clothing is pinched between the mounting flange of the tubular fan case of the air cooling blower and the mounting ring and, accordingly, the air cooling blower is mounted on the air-cooled clothing.

Furthermore, in the above state, when power is applied to the motor and the fan is driven, outside air is drawn into the tubular fan case through the air intake port of the tubular fan case on the first end side, subsequently, outside air is blown out in the outer peripheral direction of the tubular fan case through the air outlet port provided in the outer peripheral portion of the tubular fan case, subsequently, the outside air flows in the space between the air-cooled clothing and the body, and, ultimately, is discharged to the outside of the air-cooled clothing from gaps such as, for example, a collar portion and the sleeve portion, between the body and the air-cooled clothing. In other words, by having the outside air flow along the surface of the body, the sweat is vaporized, and perspiration is facilitated to cool the body by air such that the air-cooled clothing is extremely comfortable.

However, conventionally proposed air cooling blowers are not easily mounted and dismounted on and from the air-cooled clothing, and is required that it improve the above point. In other words, in conventional air cooling blowers, when the air cooling blower is mounted on the air-cooled clothing, first, a tubular fan case of the air cooling blower is inserted into a portion of a round-shaped through hole, for example, formed in the air-cooled clothing from the front side towards the back side of the air-cooled clothing. Subsequently, in the back side of the air-cooled clothing, the mounting ring is pushed into the first end side of the tubular fan case from the second end side of the tubular fan case of the air cooling blower and is moved, reaching a state in which the engagement portion of the mounting ring is engaged to the lock portion of the mounting flange; however, since the pushing in and the engaging of the engagement portion of the mounting ring to the lock portion of the mounting flange need to be proceeded at the same time, work efficiency is poor for those that are not used to the above.

Accordingly, an object of the present invention is to facilitate mounting and dismounting on and from the air-cooled clothing.

Solution to Problem

Furthermore, in order to achieve the above object, an air cooling blower of the present invention includes a tubular fan case including an air intake port on a first end side and an air outlet port on a second end side, a fan provided inside the tubular fan case, a motor that drives the fan, a mounting flange protrusively formed in an outer peripheral wall portion of the tubular fan case in an outer peripheral direction, and a mounting ring that is engaged to the mounting flange at an outer peripheral portion of the tubular fan case, in which a first lock portion is provided in a portion of the mounting flange or in a portion of the tubular fan case near the portion of the mounting flange, a second lock portion is provided in a portion of the mounting flange that opposes the first lock portion via a central axis of the tubular fan case interposed therebetween or in a portion of the tubular fan case near the portion of the mounting flange that opposes the first lock portion via the central axis of the tubular fan case interposed therebetween, a first engagement portion is provided in the mounting ring in a portion corresponding to the first lock portion of the mounting flange, a second engagement portion is provided in the mounting flange in a portion corresponding to the second lock portion, and positions where the first lock portion and the second lock portion are disposed are displaced with respect to each other in a longitudinal direction of the tubular fan case.

Advantageous Effects of Invention

The mounting and dismounting of the air cooling blower on and from the air-cooled clothing is facilitated, since, as described above, the air cooling blower of the present invention includes the tubular fan case including the air intake port on the first end side and the air outlet port on the second end side, the fan provided inside the tubular fan case, the motor that drives the fan, the mounting flange protrusively formed in the outer peripheral wall portion of the tubular fan case in the outer peripheral direction, and the mounting ring that is engaged to the mounting flange at the outer peripheral portion of the tubular fan case, in which the first lock portion is provided in the portion of the mounting flange or in the portion of the tubular fan case near the portion of the mounting flange, the second lock portion is provided in the portion of the mounting flange that opposes the first lock portion via the central axis of the tubular fan case interposed therebetween or in the portion of the tubular fan case near the portion of the mounting flange that opposes the first lock portion via the central axis of the tubular fan case interposed therebetween, the first engagement portion is provided in the mounting ring in the portion corresponding to the first lock portion of the mounting flange, the second engagement portion is provided in the mounting flange in the portion corresponding to the second lock portion, and the positions where the first lock portion and the second lock portion are disposed are displaced with respect to each other in the longitudinal direction of the tubular fan case.

In other words, in the present invention, the first lock portion is provided in the portion of the mounting flange or in the portion of the tubular fan case near the portion of the mounting flange, the second lock portion is provided in the portion of the mounting flange that is on the side that opposes the first lock portion via the central axis of the tubular fan case interposed therebetween or in the portion of the tubular fan case near the portion of the mounting flange that is on the side that opposes the first lock portion via the central axis of the tubular fan case interposed therebetween, the first engagement portion is provided in the mounting ring in a portion corresponding to the first lock portion on the mounting flange side, the second engagement portion is provided on the mounting flange side in a portion corresponding to the second lock portion, and the positions where the first lock portion and the second lock portion are disposed are displaced with respect to each other in the longitudinal direction of the tubular fan case. Accordingly, for example, when the mounting ring is engaged to the mounting flange, first, the mounting ring is fitted into the outer peripheral wall portion of the tubular fan case, subsequently, the mounting ring is slid and moved towards the mounting flange side, subsequently, the first lock portion on the mounting flange side and the first engagement portion of the mounting ring are abutted against each other, and, here, the first lock portion and the first engagement portion of the mounting ring are engaged to each other, subsequently, while the above portion serving as an axis, the second engagement portion of the mounting ring is moved to the second lock portion side on the mounting flange side and is engaged thereto; accordingly, the air cooling blower can be easily mounted on the air-cooled clothing and becomes one with good usability.

Furthermore, by forming the mounting flange in an inclined state with respect to the central axis of the tubular fan case and, further, by having a configuration in which the mounting ring is engaged to the mounting flange, the air cooling blower is mounted in a portion of the through hole of the air-cooled clothing in an inclination state and, as a result, the air outlet port of the tubular fan case on the second end side is also in a state inclined towards the outside-air discharge side of the air-cooled clothing. Furthermore, with such a configuration, most of the outside air blown out from the air outlet port of the tubular fan case can be made to flow effectively to the outside-air discharge side of the air-cooled clothing and, as a result, it will be easier to reduce the size of the air cooling blower.

Furthermore, since the air cooling blower reduced in size is easy to handle and since the mounting flange is in the inclined state, engaging of the mounting ring or canceling of the engagement, that is, mounting and dismounting of the air cooling blower on and from the air-cooled clothing can be performed easily; accordingly, the air cooling blower becomes one with good usability.

DESCRIPTION OF EMBODIMENTS

First Embodiment

Figure 1:
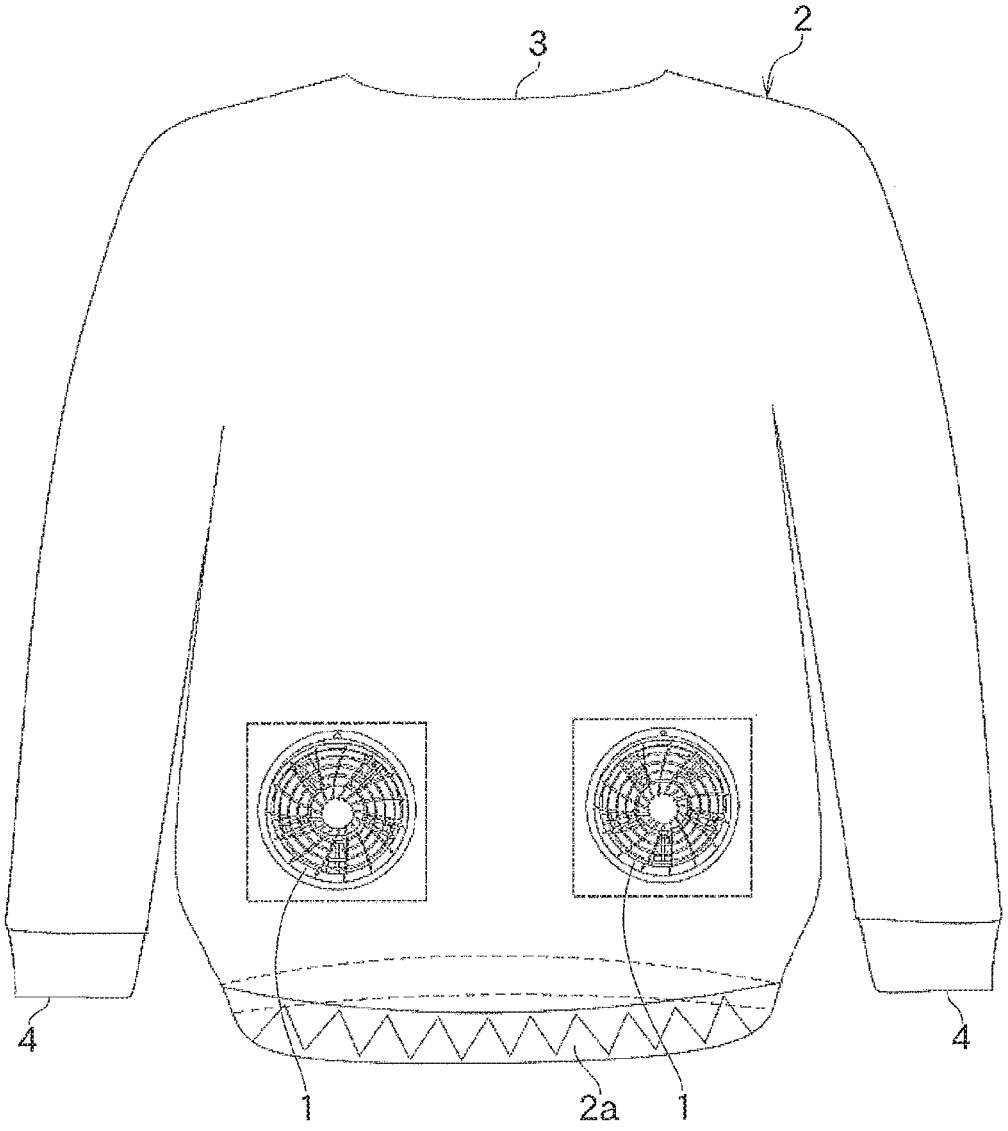
FIG. 1 is a rear view of a piece of air-cooled clothing on which the air cooling blowers according to an embodiment of the present invention are mounted.

Hereinafter, an embodiment of the present disclosure will be described with reference to the attached drawings. FIG. 1 illustrates a state in which air cooling blowers 1 according to an embodiment of the present invention are mounted on a piece of air-cooled clothing 2. In the embodiment, an example of the air-cooled clothing 2 is a jacket worn on an upper body of a human body, and two air cooling blowers 1 are mounted in a lower region of a back portion. Since the air-cooled clothing 2 is basically formed of a material with poor permeability of air, outside air that has been drawn into the air-cooled clothing 2 with the air cooling blowers 1 passes through a gap formed between the human body and the air-cooled clothing 2 and is blown out to the outside of the air-cooled clothing 2 through a collar 3 and sleeve openings 4. Furthermore, when the outside air flows through the gap formed between the human body and the air-cooled clothing 2 in the above manner, sweat on the surface of the human body is vaporized, and by discharging the vapor to the outside of the air-cooled clothing 2, perspiration is facilitated and an air cooling effect is exerted.

Note that a narrowed portion 2*a* is provided in the air-cooled clothing 2 of the present embodiment below a portion where the air cooling blowers 1 are mounted, in other words, at a portion facing the waist of the human body so that the outside air taken inside the air-cooled clothing 2 is, as described above, blown out to the outside of the air-cooled clothing 2 through the collar 3 and the sleeve openings 4. In other words, since there are many wearers that feel cooler when the air is sent to the face, the neck, and the wrist portions, the outside air drawn in with the air cooling blowers 1 is, as described above, made to flow towards the upper side of the air-cooled clothing 2 in a biased state.

Figure 2:
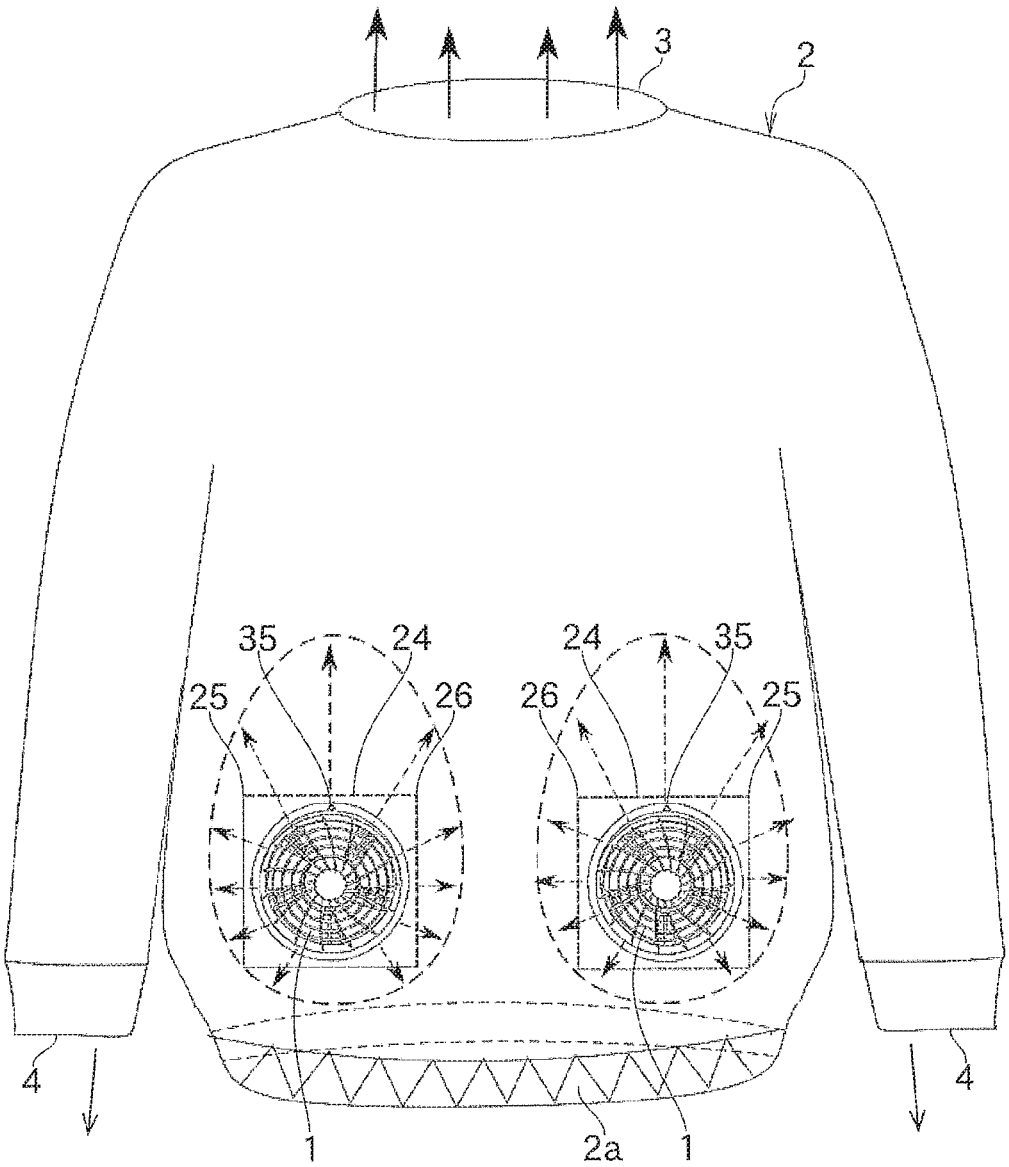
FIG. 2 is a rear view of a piece of air-cooled clothing on which the air cooling blowers according to an embodiment of the present invention are mounted.
Figure 3:
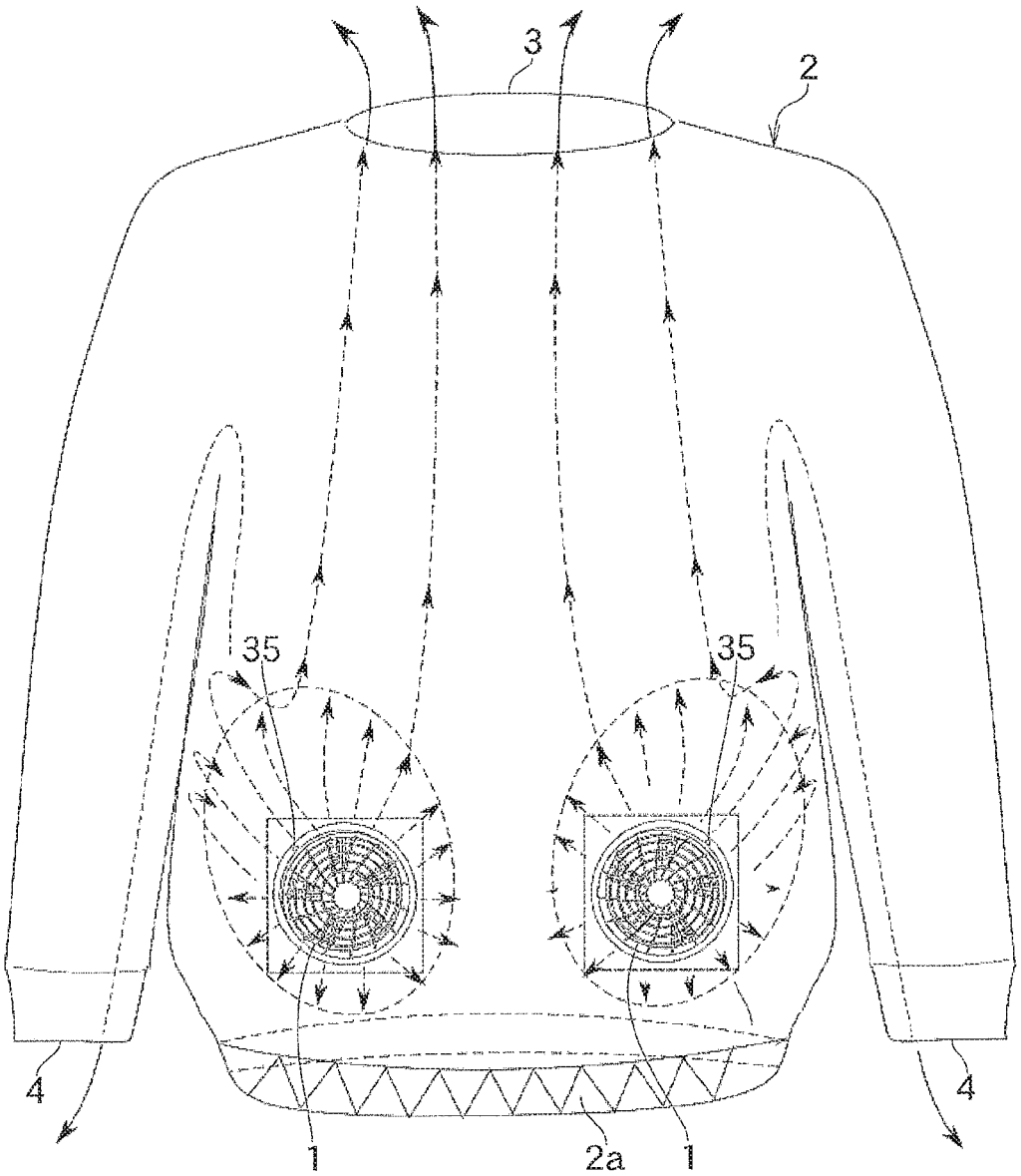
FIG. 3 is a rear view of a piece of air-cooled clothing on which the air cooling blowers according to an embodiment of the present invention are mounted.
Figure 4:
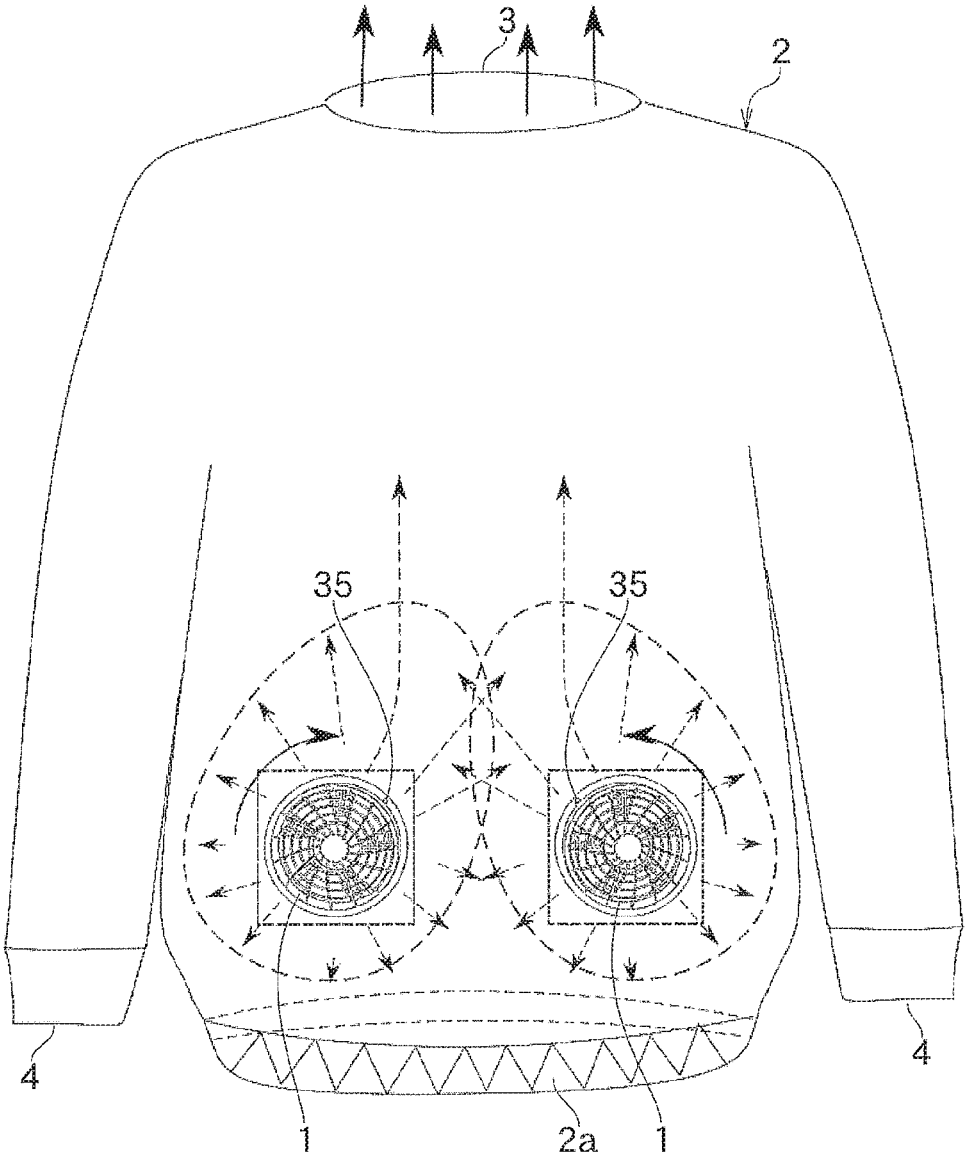
FIG. 4 is a rear view of a piece of air-cooled clothing on which the air cooling blowers according to an embodiment of the present invention are mounted.

Furthermore, as illustrated in FIGS. 2 to 4, the air cooling blowers 1 of the present embodiment are capable of meeting the cooling preferences of the individual by adjusting the angles thereof attached to the air-cooled clothing 2 and adjusting the amount of air flow out through the collar 3 and the sleeve openings 4. The above will be described in detail later.

Hereinafter, a configuration of the air cooling blower 1 will be described in detail. As illustrated in FIGS. 5 to 8, the air cooling blower 1 includes a tubular fan case 6 including an air intake port 5*a* on a first end side (the outer side of the air-cooled clothing 2) and an air outlet port 5*b* on a second end side (the inner side of the air-cooled clothing 2), a fan 7 provided in a central axis X portion inside the tubular fan case 6, a motor 8 that drives the fan 7, a mounting flange 9 formed so as to project from an entire peripheral portion of an outer peripheral wall of the tubular fan case 6 in an outer peripheral direction, a ring-shape mounting ring 10 engaged to the mounting flange 9 at the outer peripheral portion of the tubular fan case 6.

The following four points are the features of the present embodiment.

(1) As illustrated in FIGS. 5 to 14, the air intake port 5*a* is provided on the first end side (the outer side of the air-cooled clothing 2) of the tubular fan case 6, and the air outlet port 5*b* is provided on the second end side (the inner side of the air-cooled clothing 2).

(2) Furthermore, the mounting flange 9 is integrally formed from the outer peripheral wall portion of the tubular fan case 6 in the outer peripheral direction in the outer peripheral wall portion of the tubular fan case 6 between the air intake port 5*a* and the air outlet port 5*b* in an inclined state with respect to the central axis X of the tubular fan case 6.

(3) Moreover, hook-shaped first lock portions 11 are provided in portions of a peripheral portion of the mounting flange 9 or in portions of the tubular fan case 6 near the portions of the peripheral portion of the mounting flange 9, and a through-hole-shaped second lock portion 12 is provided in a portion of the peripheral portion of the mounting flange 9 that opposes the first lock portions 11 via the central axis X of the tubular fan case 6 interposed therebetween or in a portion of the tubular fan case 6 near the portion of the peripheral portion of the mounting flange 9 that opposes the first lock portions 11 via the central axis X of the tubular fan case 6 interposed therebetween. In other words, the first lock portions 11 and the second lock portion 12 are disposed at different positions in a longitudinal direction of the tubular fan case 6 (between the air intake port 5*a* and the air outlet port 5*b*). Specifically, as it can be understood from FIGS. 5 and 6, the first lock portions 11 are provided on the air outlet port 5*b* side with respect to the second lock portion 12. In other words, the first lock portions 11 are formed in an end portion on the air outlet port 5*b* side of the tubular fan case 6 and, in such a state, is provided on the air outlet port 5*b* side with respect to the second lock portion 12. Furthermore, as it can be understood from FIGS. 5 and 6, since the through-hole-shaped second lock portion 12 is provided in the outer peripheral portion of the tubular fan case 6, the through-hole-shaped second lock portion 12 is provided on the air intake port 5*a* side with respect to the first lock portions 11 formed in the end portion on the air outlet port 5*b* side of the tubular fan case 6.

(4) Furthermore, as illustrated in FIGS. 5, 6, and 7, and FIGS. 16 to 20, notch-shaped first engagement portions 13 are provided at portions in the mounting ring 10 corresponding to the first lock portions 11, and a hook-shaped second engagement portion 14 is provided at portions in the mounting ring 10 corresponding to the second lock portion 12.

Figure 5:
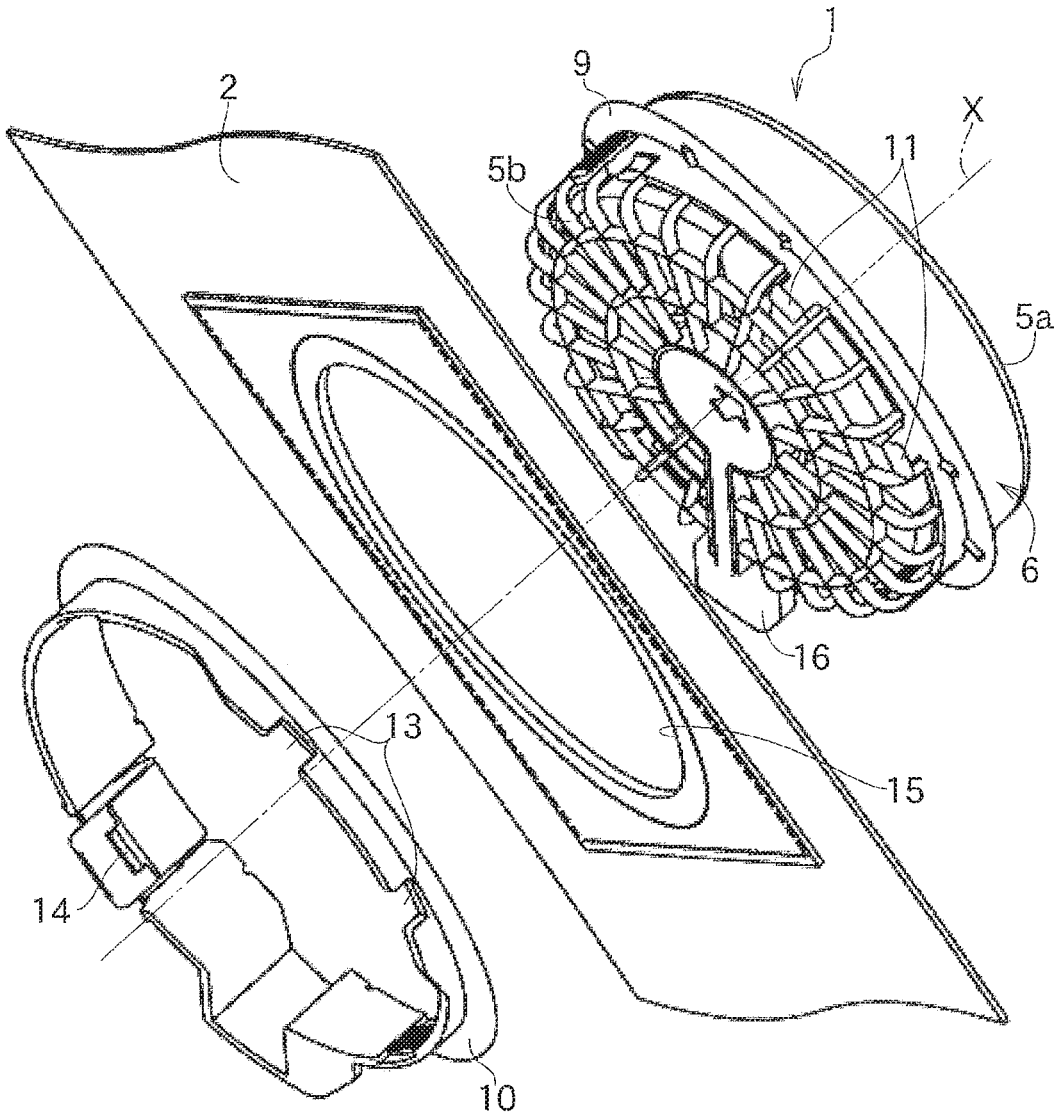
FIG. 5 is an exploded perspective view of the air cooling blower.
Figure 6:
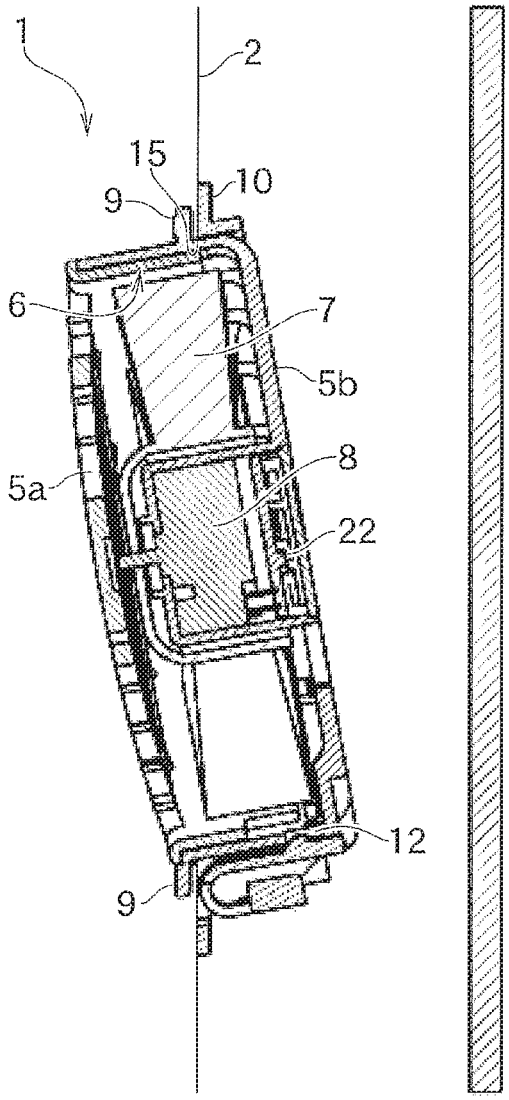
FIG. 6 is a cross-sectional view of the air cooling blower.
Figure 7:
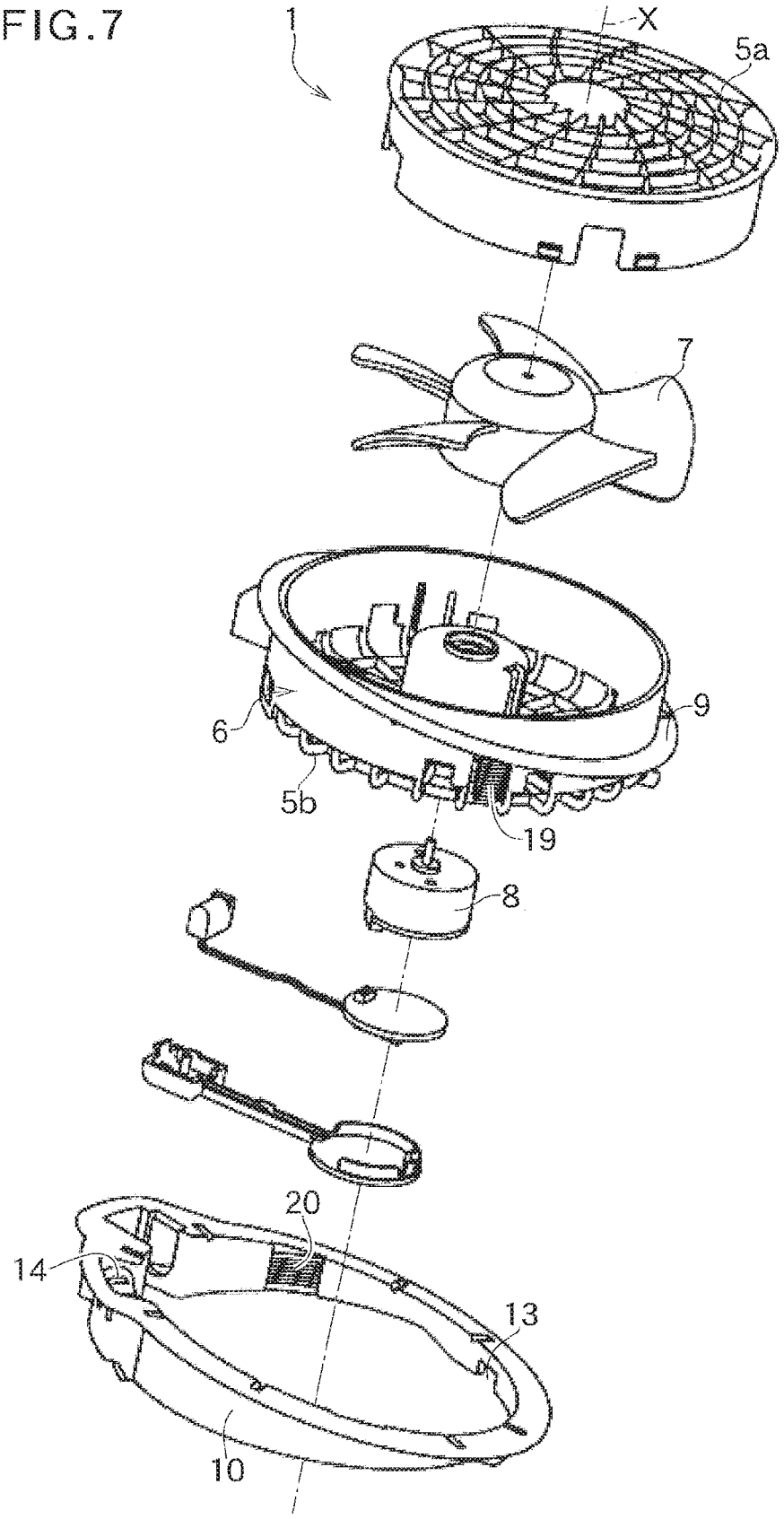
FIG. 7 is an exploded perspective view of the air cooling blower.
Figure 8:
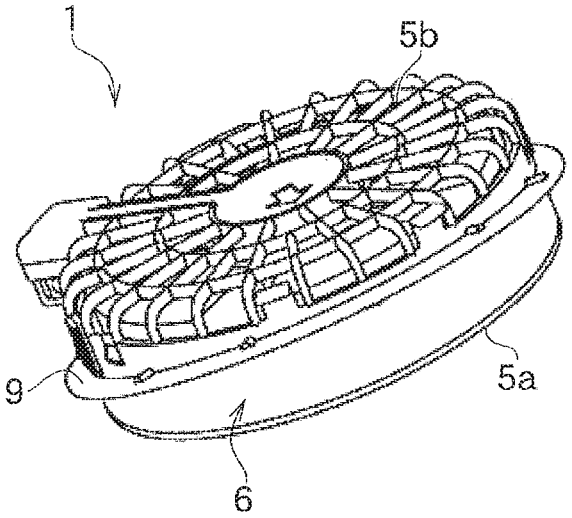
FIG. 8 is a perspective view of the air cooling blower.

In other words, since the present embodiment is configured such that the air outlet port 5*b* is provided on the second end side of the tubular fan case 6, the mounting flange 9 provided on the outer peripheral wall portion of the tubular fan case 6 between the air intake port 5*a* and the air outlet port 5*b* is formed in an inclined state with respect to the central axis X of the tubular fan case 6, and the mounting ring 10 is engaged with the mounting flange 9, as it can be understood from FIGS. 5 and 6, the air cooling blowers 1 are mounted in a through hole 15 portion of the air-cooled clothing 2 in an inclined state, and as a result, as in FIG. 6, the air outlet port 5*b* on the second end side of the tubular fan case 6 is also in a state inclined towards an outside-air discharge side (the collar 3 and the sleeve openings 4 on the upper side) of the air-cooled clothing 2. Accordingly, as it can be understood from FIGS. 2 to 4, most of the air blown out through the air outlet port 5*b* of the tubular fan case 6 can be made to flow effectively towards the outside-air discharge side (the collar 3 and the sleeve openings 4 on the upper side) of the air-cooled clothing 2 and, as a result, a reduction in the size of the air cooling blowers 1 can be facilitated.

Furthermore, since the air cooling blower 1 reduced in size is easy to handle and since the mounting flange 9 is in the inclined state, engaging of the mounting ring 10 or canceling of the engagement, that is, mounting and dismounting of the air cooling blower 1 on and from the air-cooled clothing 2 can be performed easily; accordingly, the air cooling blower 1 becomes one with good usability.

In other words, in the present embodiment, the hook-shaped first lock portions 11 are provided in the portions of the mounting flange 9 in the inclined state described above or in the portions of the tubular fan case 6 near the portions of the mounting flange 9, and the through-hole-shaped second lock portion 12 is provided in the portion of the mounting flange 9 that opposes the first lock portions 11 via the central axis X of the tubular fan case 6 interposed therebetween or in the portion of the tubular fan case 6 near the portion of the mounting flange 9 that opposes the first lock portions 11 via the central axis X of the tubular fan case 6 interposed therebetween, and the notch-shaped first engagement portions 13 are provided at the portions in the mounting ring 10 corresponding to the first lock portions 11, and the second engagement portion 14 is provided at the portion in the mounting ring 10 corresponding to the second lock portion 12. Furthermore, in the above state, the first and second lock portions 11 and 12 are disposed so as to have a difference in positions in the longitudinal direction of the tubular fan case 6.

Accordingly, for example, as in FIGS. 5 and 6, when mounting the air cooling blower 1 on the air-cooled clothing 2, the air outlet port 5*b* of the air cooling blower 1 is first inserted into the through hole 15 of the air-cooled clothing 2 from the front side of the air-cooled clothing 2, and a surface of the mounting flange 9 on the air outlet port 5*b* side is abutted against an opening edge of the through hole 15 of the air-cooled clothing 2. Subsequently, the mounting ring 10 is fitted into the outer peripheral wall portion of the tubular fan case 6 from the back side of the air-cooled clothing 2 and is slid and moved towards the mounting flange 9 side. Then, the first lock portions 11 on the mounting flange 9 side and the first engagement portions 13 of the mounting ring 10 are abutted against each other and, here, the first lock portions 11 on the mounting flange 9 side and the first engagement portions 13 of the mounting ring 10 are engaged with each other. Subsequently, while the above portion serves as an axis, the second engagement portion 14 of the mounting ring 10 is slid and moved towards the second lock portion 12 on the mounting flange 9 side; accordingly, the air cooling blower 1 can be easily mounted on the air-cooled clothing 2 and becomes one with good usability.

Furthermore, when cancelling the engagement between the mounting ring 10 and the mounting flange 9, while the portion of engagement between the first lock portions 11 on the mounting flange 9 side and the first engagement portions 13 of the mounting ring 10 serves as an axis, the second engagement portion 14 of the mounting ring 10 is to be pulled and detached from the second lock portion 12 on the mounting flange 9 side. Subsequently, by sliding the mounting ring 10 towards the air outlet port 5*b* side of the tubular fan case 6 and dismounting the mounting ring 10 from the tubular fan case 6, the air cooling blower 1 can be easily dismounted from the air-cooled clothing 2 and becomes one with good usability.

In contrast, in the case of the conventional art in which the mounting flange projects orthogonally with respect to the fan case, the first and second lock portions of the mounting flange are provided in the same position in the longitudinal direction of the tubular fan case; accordingly, the engagement or the cancellation of the engagement between the first lock portions and the first engagement portions, and between the second lock portion and the second engagement portion are mostly performed at the same time in engaging the mounting ring to the mounting flange or cancelling the engagement, making the work intricate.

In other words, in the present embodiment, since the mounting flange 9 is inclined and a difference in positions of the first and second lock portions 11 and 12 in the longitudinal direction (in the axial direction) of the tubular fan case 6 is provided, the engaging of the mounting ring 10 to the mounting flange 9 and the cancelling of the engagement from the above state are easily performed and, as a result, the mounting of the air cooling blower 1 on the air-cooled clothing 2 and the dismounting thereof becomes extremely easy to perform such that the air cooling blower 1 becomes one with good usability.

Note that in the present embodiment, since the first lock portions 11 are provided in an inclined portion of the mounting flange 9 on the air outlet port 5*b* side of the tubular fan case 6, or in the vicinity thereof, a large engagement stroke of the second engagement portion 14 of the mounting ring 10 towards the air intake port 5*a* side can be provided; accordingly, the air cooling blower 1 becomes one with good usability. Furthermore, in the present embodiment, the attaching and detaching movements of the mounting ring 10 becomes stable since the plurality of first lock portions 11 of the mounting flange 9 and the plurality of first engagement portions 13 of the mounting ring 10 are provided and the second engagement portion 14 of the mounting ring 10 side is pivoted towards the second lock portion 12 on the mounting flange 9 side while the portion where the first lock portions 11 and the first engagement portions 13 engage with each other serves as an axis.

Moreover, in the present embodiment, since the second lock portion 12 is provided on the intake port 5*a* side with respect to the first lock portions 11 of the tubular fan case 6 (on the intake port 5*a* side with respect to the air outlet port 5*b*) and in the mounting flange 9 or in the portion of the tubular fan case 6 in the vicinity of the mounting flange 9, a large engagement stroke of the second engagement portion 14 of the mounting ring 10 towards the second lock portion 12 can be provided, a bodily sensation of attaching and detaching can be actually felt, and the air cooling blower 1 becomes one with good usability.

Furthermore, the present embodiment is configured such that, as illustrated in FIGS. 22 to 27, an portion 16 that energizes the motor 8 is provided on the side of the tubular fan case 6 where the inclined mounting flange 9 approaches the intake port 5*a* and on the air outlet port 5*b* side of the tubular fan case 6 (on the air outlet port 5*b* side with respect to the intake port 5*a*), and a plug 17 for energizing is detachably inserted therein. In other words, the above portion is a portion that becomes separated from the mounting flange 9; accordingly, the portion 16 that energizes is easily set and the mounting flange 9 is rarely an impediment when attaching and detaching the plug 17.

Figure 21:
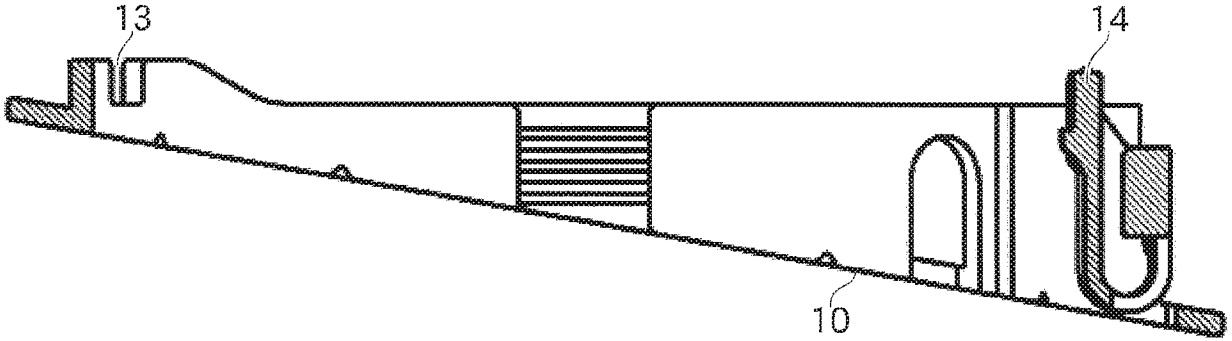
FIG. 21 is an enlarged cross-sectional view of the mounting ring of the air cooling blower taken along line A-A.

Moreover, in the present embodiment, as illustrated in FIG. 21, the second engagement portion 14 of the mounting ring 10 has a U-shape in cross-sectional view, is integrated with the mounting ring 10 at a portion of the mounting ring 10 on the intake port 5*a* side of the tubular fan case 6 (on the intake port 5*a* side with respect to the air outlet port 5*b*), and is formed so as to extend from the integrated portion to the air outlet port 5*b* side of the tubular fan case 6 with respect to the mounting ring 10. In other words, by forming the second engagement portion 14 to extend in the mounting ring 10 from the intake port 5*a* side of the tubular fan case 6 towards the air outlet port 5*b* of the tubular fan case 6 and, further, to the air outlet port 5*b* side with respect to the mounting ring 10, the second engagement portion 14 can be formed in a long lever shape and, as a result, when external force is applied on the distal end side when work is performed thereon, the base side serving as a fulcrum is easily bent and the air cooling blower 1 becomes one with good operability.

Figure 15:
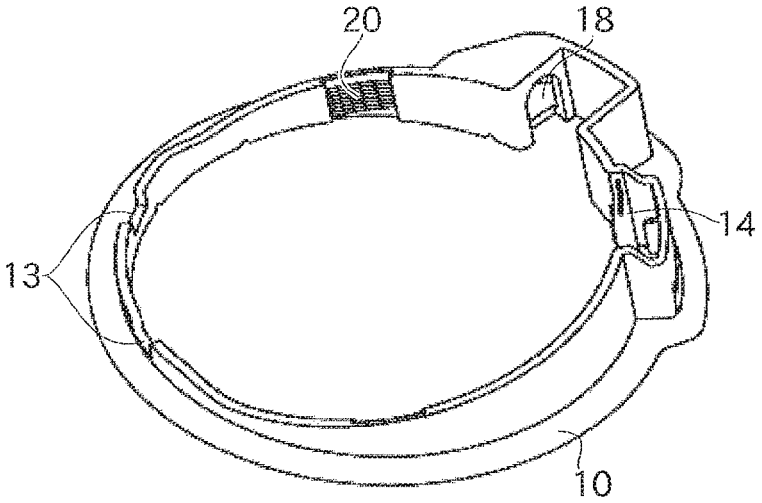
FIG. 15 is a perspective view of a mounting ring of the air cooling blower.
Figure 16:
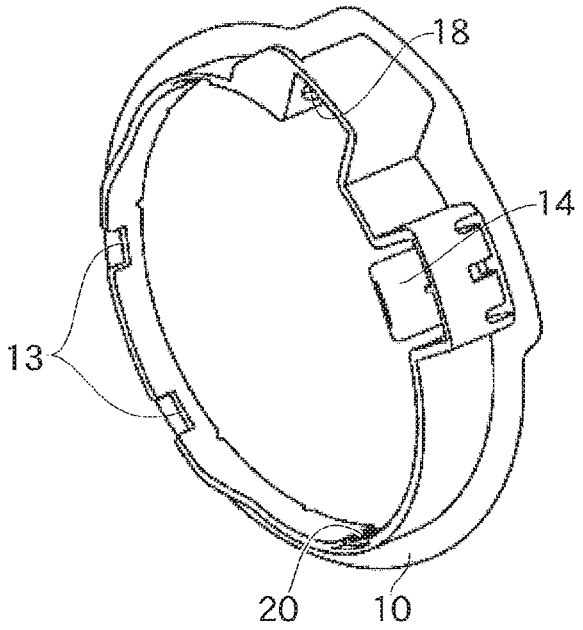
FIG. 16 is a perspective view of the mounting ring of the air cooling blower.
Figure 17:
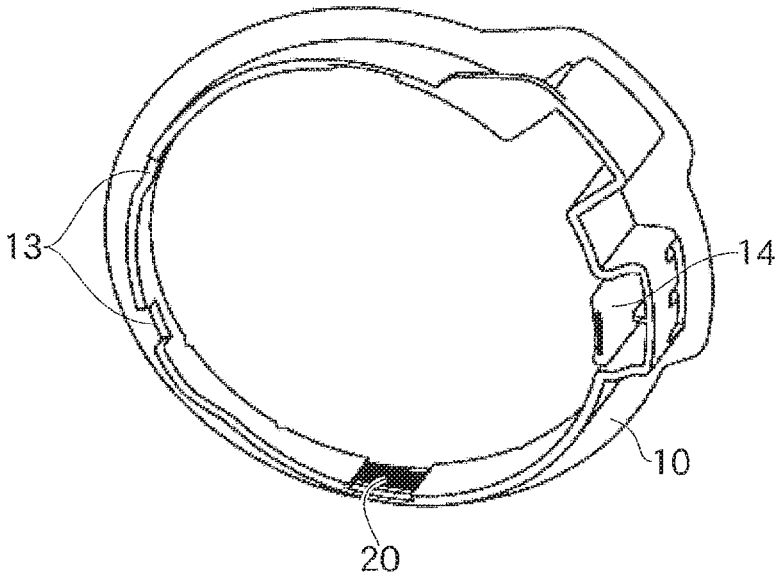
FIG. 17 is a perspective view of the mounting ring of the air cooling blower.
Figure 18:
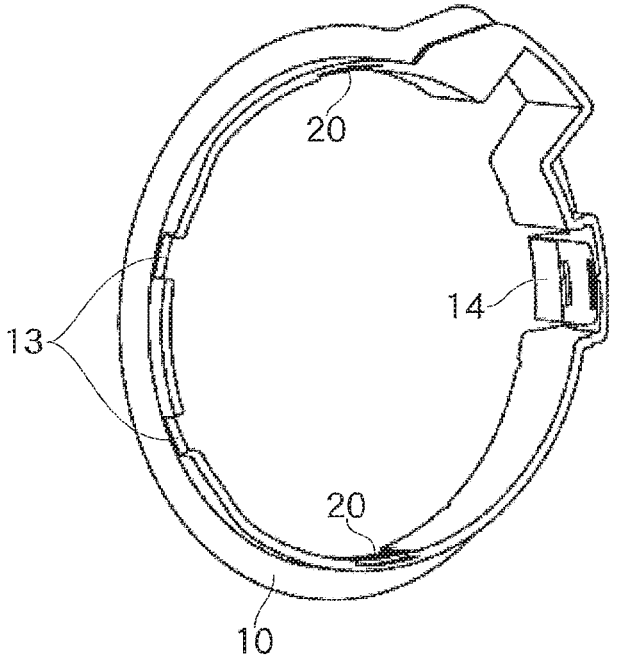
FIG. 18 is a perspective view of the mounting ring of the air cooling blower.
Figure 19:
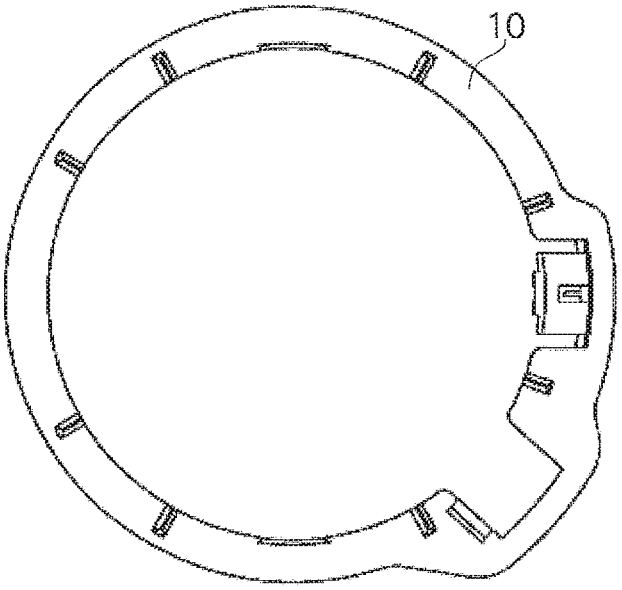
FIG. 19 is a plan view of the mounting ring of the air cooling blower.
Figure 20:
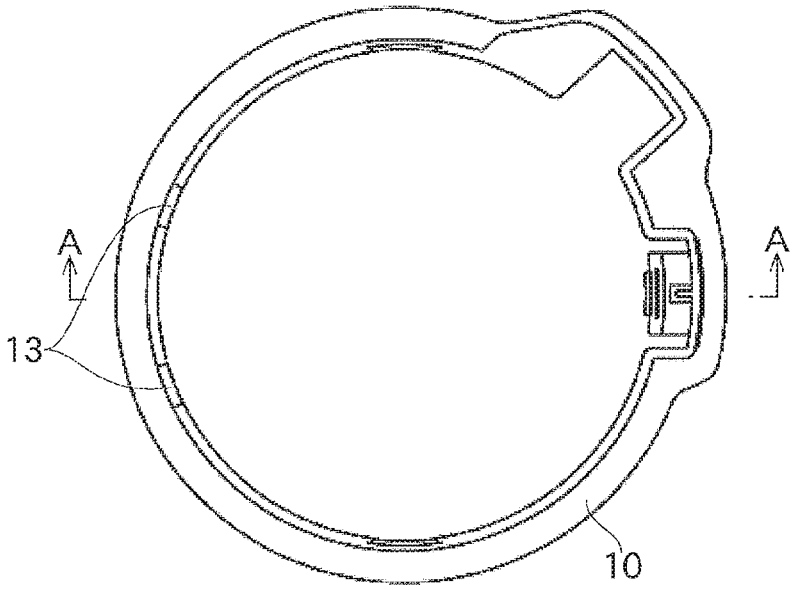
FIG. 20 is a rear view of the mounting ring of the air cooling blower.

Furthermore, as illustrated in FIGS. 15 and 16, in the present embodiment, a through hole 18 through which the plug 17, which connects the motor 8 to the energizing portion, penetrates is provided in the vicinity of the second engagement portion 14 of the mounting ring 10. Accordingly, in a state in which the plug 17 is mounted on the portion 16 that energizes, the plug 17 is in a state penetrating the through hole 18 of the mounting ring 10 and, as a result, the engagement between the second engagement portion 14 of the mounting ring 10 and the second lock portion 12 on the tubular fan case 6 side is not easily cancelled unintentionally.

Moreover, in the present embodiment, as illustrated in FIGS. 5, 12, 13, and 22, a first recessed and protruded portion 19 alternatively protruded towards the outer peripheral direction between the air intake port 5*a* on the first end side of the tubular fan case 6 and the air outlet port 5*b* on the second end side is provided in a portion between the mounting flange 9 or the portion of the first lock portions 11 of the tubular fan case 6 in the vicinity of the mounting flange 9 and the second lock portion 12. Furthermore, as illustrated in FIGS. 15 to 18, a second recessed and protruded portion 20 alternatively protruded inwardly is provided in a portion of the mounting ring 10 corresponding to the first recessed and protruded portion 19. Accordingly, the engagement in the outer peripheral portion of the tubular fan case 6 between the first lock portions 11 and the second lock portion 12 on the tubular fan case 6 and mounting flange 9 side, and the first engagement portions 13 and the second engagement portion 14 on the mounting ring 10 side can be brought to an engaged state with the first and second recessed and protruded portions 19 and 20. Furthermore, since the first and second recessed and protruded portions 19 and 20 are each formed of a plurality of recesses and protrusions, the sliding becomes piecemeal through the recesses and protrusions. By engaging the mounting flange 9 and the mounting ring 10 to each other at optional intervals corresponding to the number of recesses and protrusions, the thickness differences of the air-cooled clothing 2 can be absorbed and the attachment can be stabilized; accordingly, the first and second recessed and protruded portions 19 and 20 are extremely useful.

Furthermore, the mounting ring 10 attached and detached in the above manner has a color that is lighter than that of the tubular fan case 6 or the mounting flange 9. In other words, by having the mounting ring 10 have a color that is different from that of the tubular fan case 6 or the mounting flange 9 and, moreover, a lighter color, the mounting ring 10 can be recognized as a member different from the tubular fan case 6 or the mounting flange 9, and the mounting of the mounting ring 10 to the tubular fan case 6 or the dismounting the mounting ring 10 in the above state can be performed easily. Moreover, by having the mounting ring 10 to have a fluorescent color, mounting and dismounting can be performed easily in dark places as well.

Figure 9:
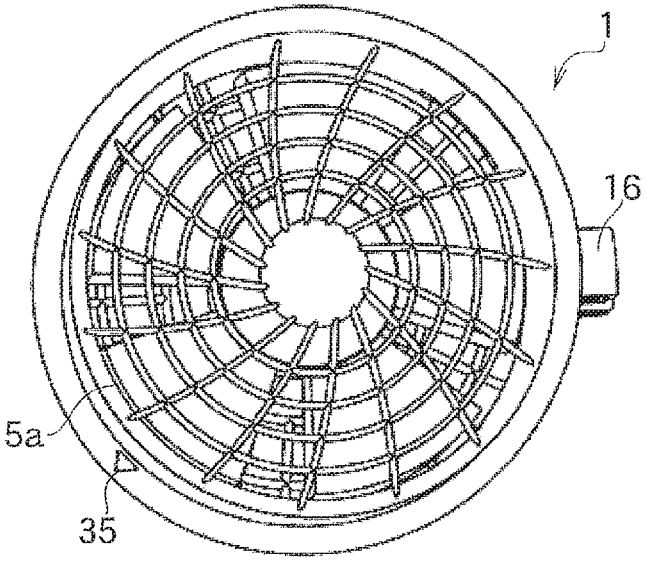
FIG. 9 is a plan view of the air cooling blower.
Figure 10:
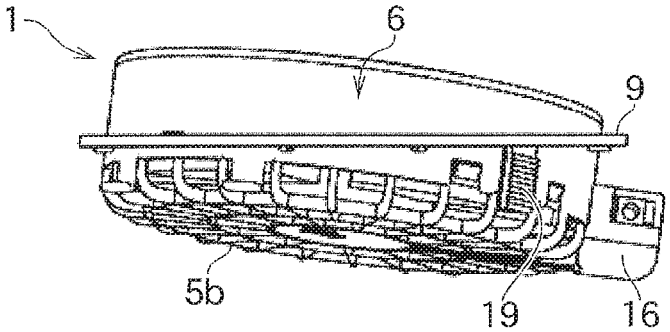
FIG. 10 is a side view of the air cooling blower.
Figure 11:
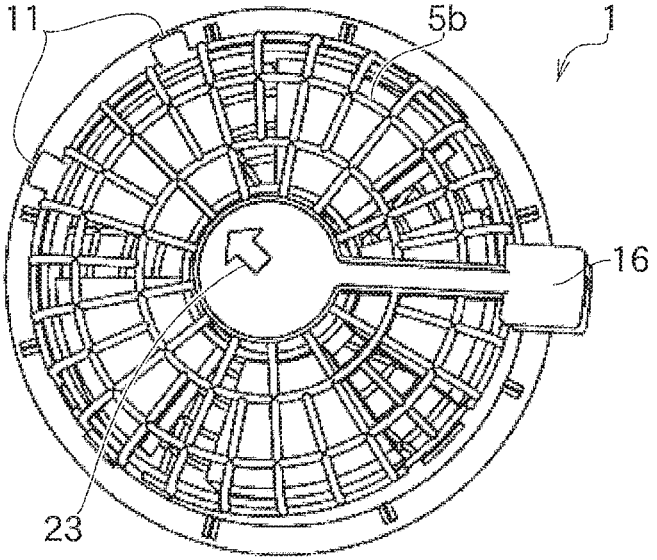
FIG. 11 is a rear view of the air cooling blower.
Figure 12:
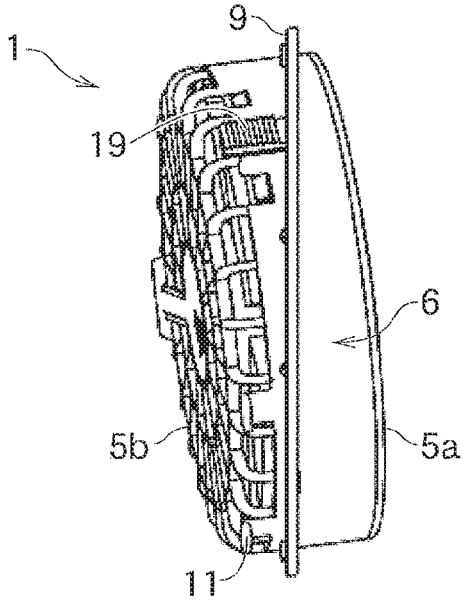
FIG. 12 is a side view of the air cooling blower.
Figure 13:
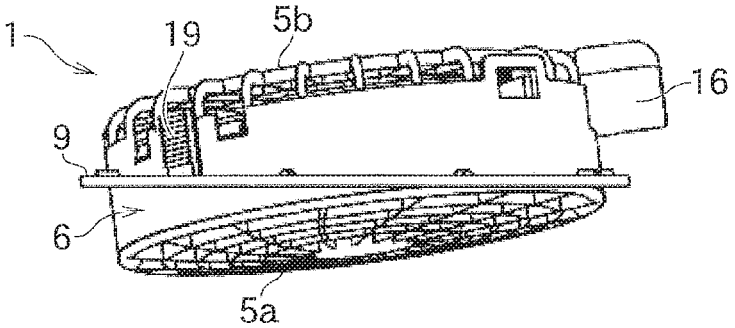
FIG. 13 is a side view of the air cooling blower.
Figure 14:
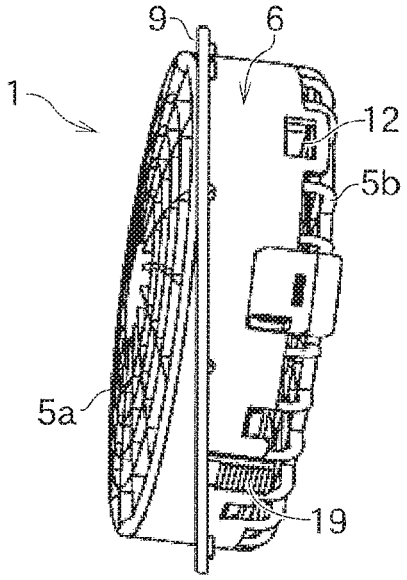
FIG. 14 is a side view of the air cooling blower.
Figure 22:
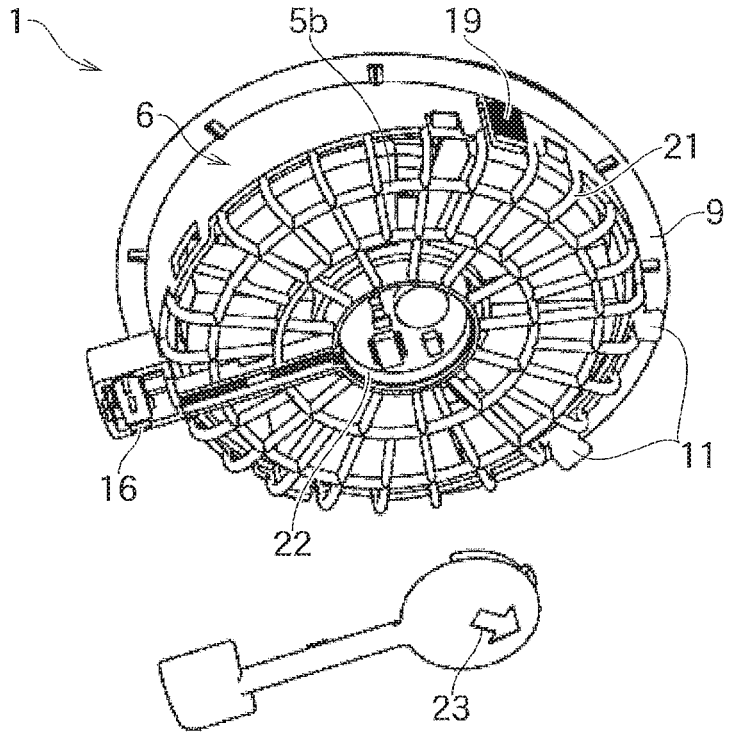
FIG. 22 is an exploded perspective view of the air cooling blower.
Figure 23:
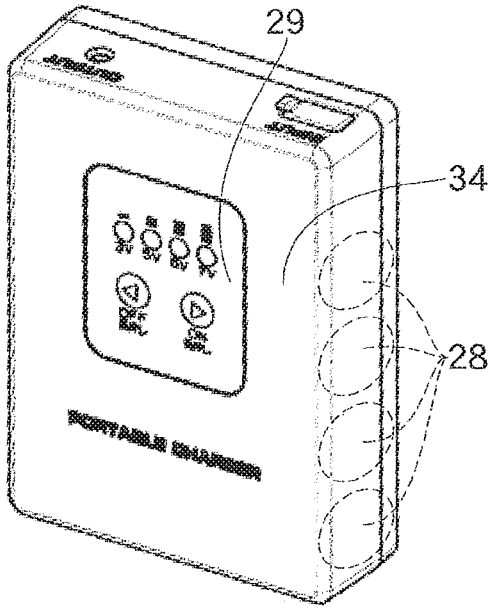
FIG. 23 is a perspective view of a controller of the air cooling blower.

Furthermore, in the present embodiment, as in FIG. 22, an air flow guide 21 is provided in a portion of the air outlet port 5*b* of the tubular fan case 6. As illustrated in FIG. 6, a motor attachment portion 22 that attaches the motor 8 is provided at the center portion of the air flow guide 21, and a first fitting reference mark 23 is provided in an outside portion the tubular fan case 6 of the motor attachment portion 22. Furthermore, as illustrated in FIG. 9, a second fitting reference mark 35 is provided in the flange 9 as well. Accordingly, an air sending state in FIGS. 2 to 4 can be formed using the first fitting reference mark 23 or the second fitting reference mark 35.

For example, the direction in which the outside air is blown out can be adjusted by matching the first fitting reference mark 23 with two corners 25 and 26 of a frame-shaped seam 24, serving as a mark, on the back side of the air-cooled clothing 2 in FIG. 2 or the in-between thereof (the corners 25 and 26, or the in-between thereof serves as an attaching reference mark of the air-cooled clothing 2). In other words, since each air cooling blower 1 is attached to the air-cooled clothing 2 by using the mounting flange 9 in the inclined state and the mounting ring 10, the amount of air flow out through the collar 3 and the sleeve openings 4 can be adjusted by adjusting the angles as illustrated in FIGS. 2 to 4 so as to be adjustable according to the cooling preference of the individual. A similar adjustment can be performed by rotating the air cooling blowers 1 in a direction in which the second fitting reference marks 35 move away from each other or in a direction in which the second fitting reference marks 35 face each other on the cloth of the air-cooled clothing 2.

Furthermore, in the present embodiment, as in FIGS. 6 and 22, a drive circuit 27 of the motor 8 is provided in a portion inside the tubular fan case 6 of the motor attachment portion 22 and, from this viewpoint as well, reduction in size of the air cooling blower 1 is facilitated. In other words, the above portion is a portion where the motor 8 exists, and is a portion where the flow of the outside air is originally small; accordingly, the above space is used to provide the drive circuit 27 so as to achieve reduction in size.

Figure 24:
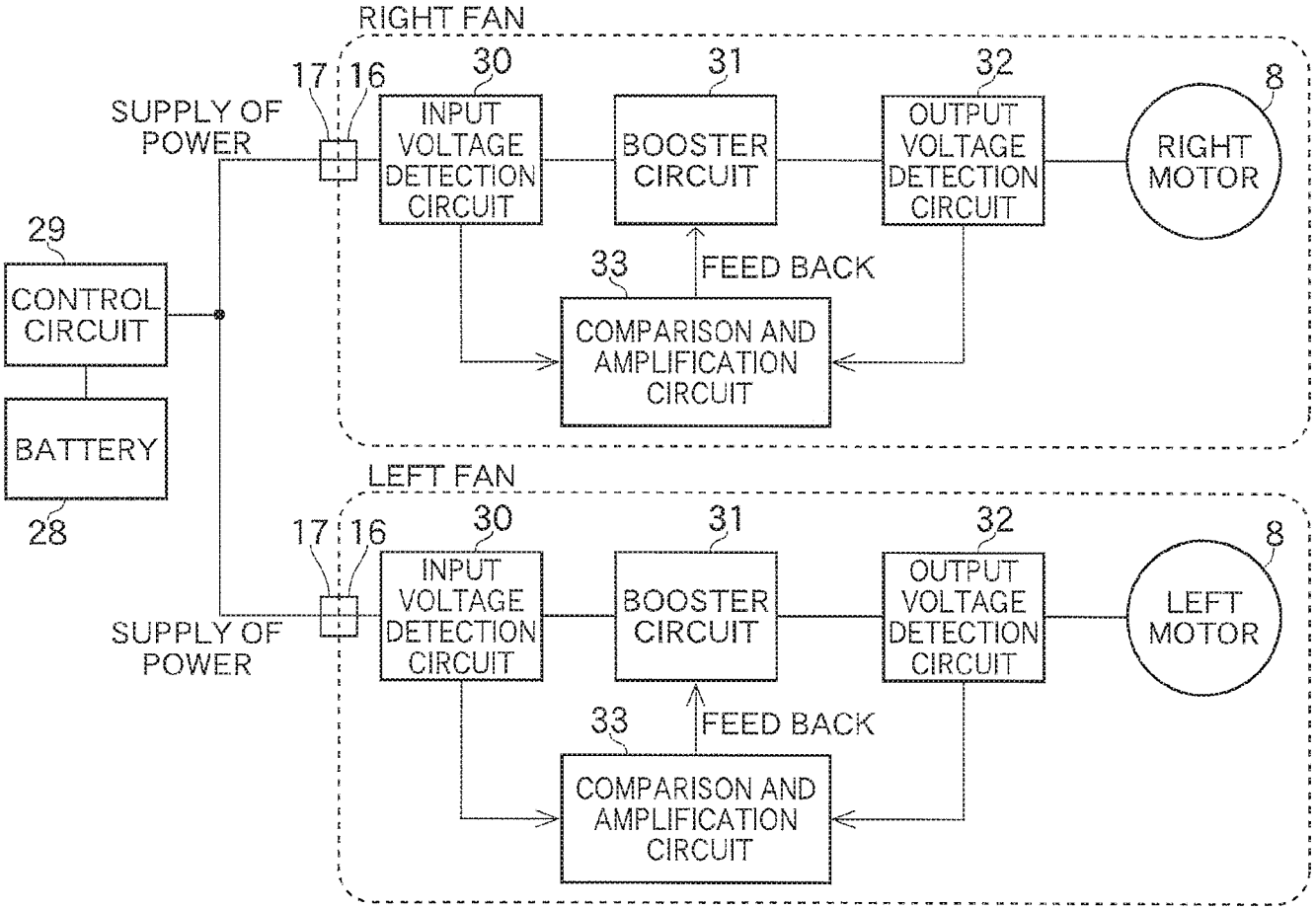
FIG. 24 is a circuit diagram of the air cooling blower.

Note that as illustrated in FIG. 24, each drive circuit 27 is a circuit that supplies a voltage supplied from batteries 28 through a control circuit 29 to the motor 8 through an input voltage detection circuit 30, a booster circuit 31, and an output voltage detection circuit 32, and the voltages of the input voltage detection circuit 30 and the output voltage detection circuit 32 are feedback controlled through a comparison and amplification circuit 33. Furthermore, the batteries 28 and the control circuit 29 are housed inside an external case 34 illustrated in FIG. 23, and are held on a waist portion of the body, for example. Note that the drive circuit 27 of the motor is configured to output a motor drive voltage proportionate to the input voltage to the motor 8.

Second Embodiment

Figure 25:
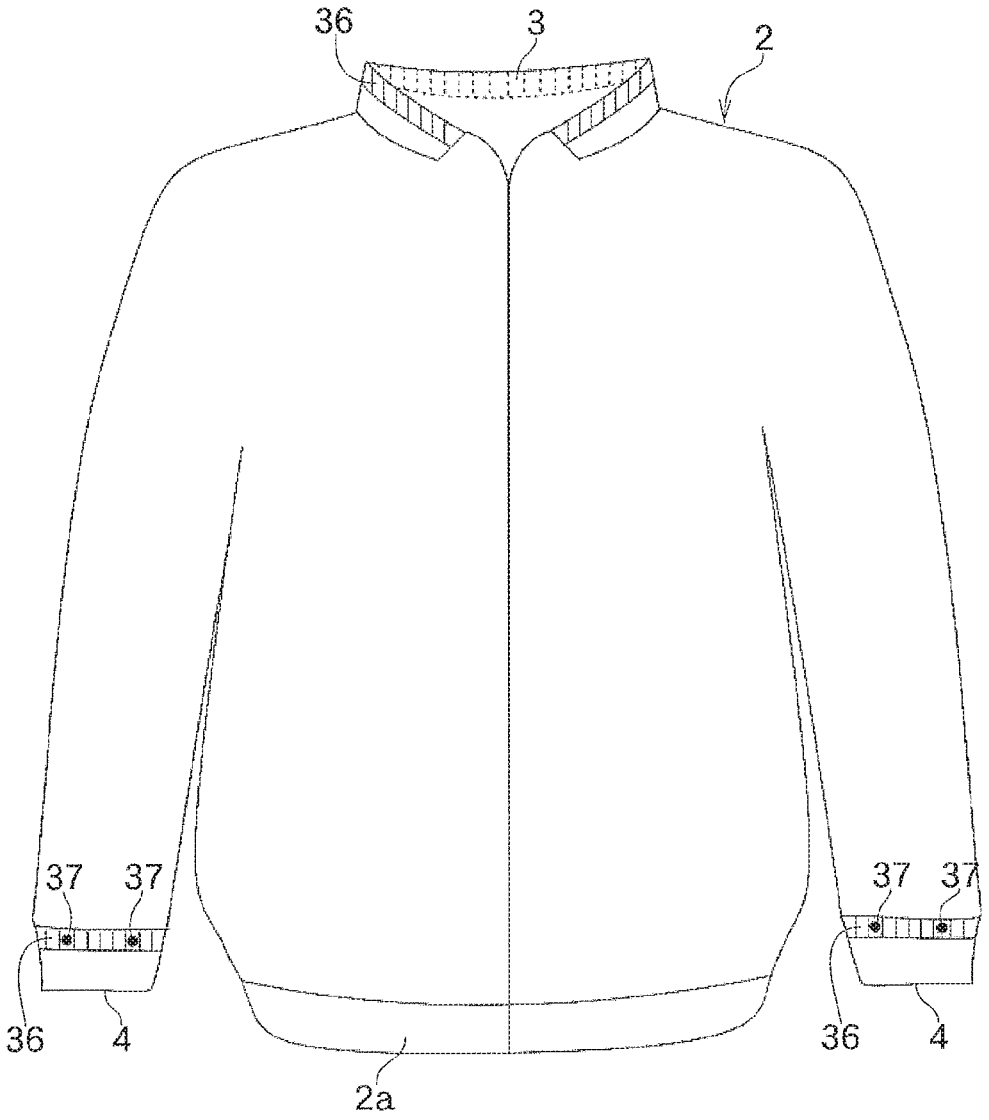
FIG. 25 is a front view of another piece of air-cooled clothing on which the air cooling blowers according to an embodiment of the present invention are mounted.
Figure 26:
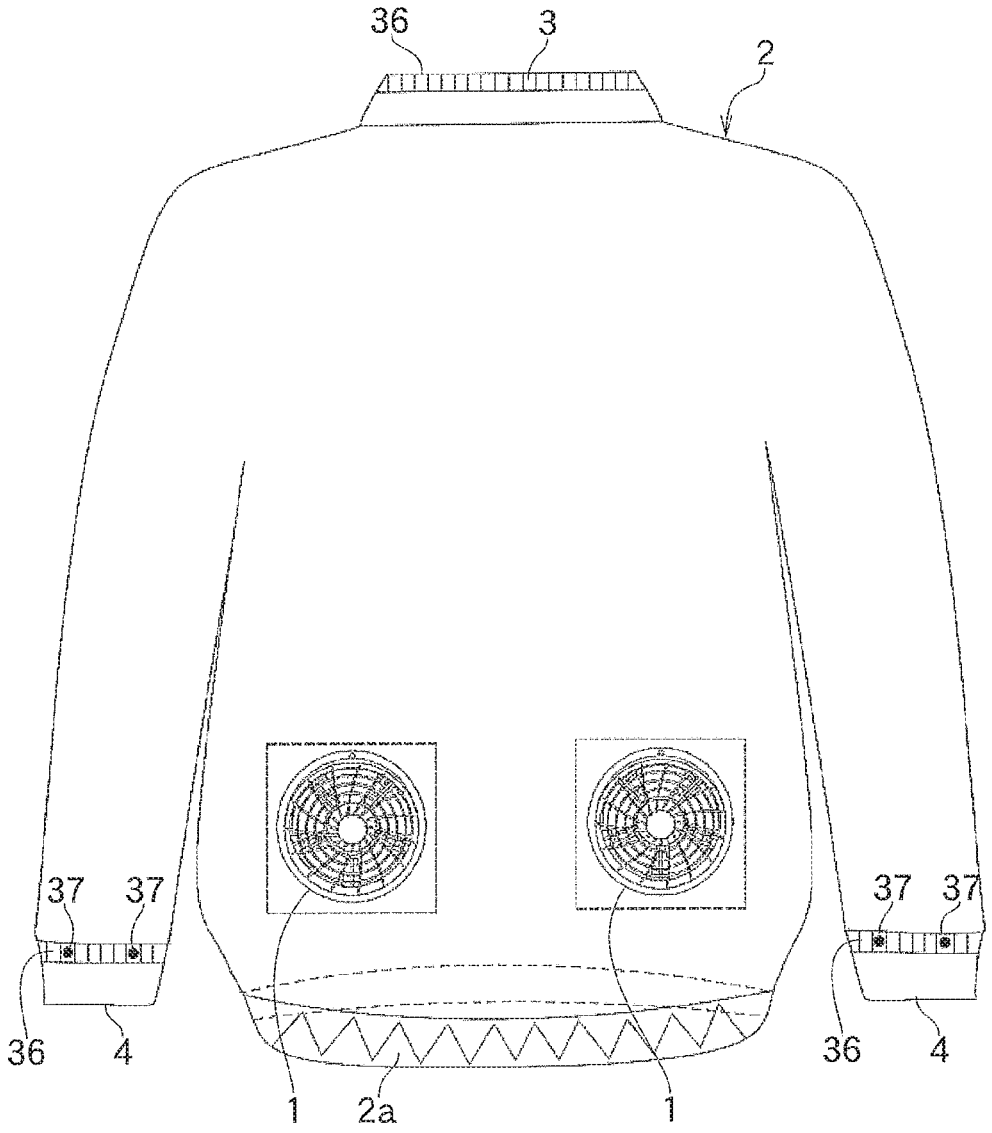
FIG. 26 is a rear view of the air-cooled clothing.

FIGS. 25 and 26 illustrate a state in which air cooling blowers 1 according to another embodiment of the present invention are mounted on a piece of air-cooled clothing 2. The air cooling blowers 1 used in the second embodiment have exactly the same configuration as that of the first embodiment; accordingly, in order to avoid complicating the description, description thereof is omitted.

In other words, the configuration of the air cooling blowers 1 used in the embodiment has a configuration in FIGS. 5 to 24. A feature of the embodiment is that chemical agent retaining portions 36 aimed to exterminate insect pests (a mosquito, for example) and repel insect pest are provided in portions of the collar 3 and the sleeve openings 4 of the air-cooled clothing 2. Specifically, the chemical agent retaining portions 36 are configured in a non-water repellant state and a porous state so as to be impregnated with and to retain an appropriate amount of a liquid chemical agent (a pyrethroid chemical agent) when the chemical agent is coated or sprayed; accordingly, when the chemical agent (the pyrethroid chemical agent) is coated or sprayed thereto, the chemical agent can be retained an appropriate time. Furthermore, the chemical agent retaining portions 36 are provided on the outer surfaces of the air-cooled clothing 2, and are configured so as to be rarely in contact with the human body. In other words, the chemical agent retaining portions 36 are portions provided separately on the outer surfaces of the air-cooled clothing 2, and the outside air in the air cooling blowers 1 described above passes through the inside of the air-cooled clothing 2 and is blown out to the outside through the portions of the collar 3 and sleeve openings 4 of the air-cooled clothing 2.

However, since the chemical agent retaining portions 36 are provided in the vicinities of the opening portions of the collar 3 and sleeve openings 4 of the air-cooled clothing 2, when the outside air of the air cooling blowers 1 is vigorously blown out to the outside of the air-cooled clothing 2 from the portions in the collar 3 and the sleeve openings 4, the wind attracted by the airflow flows along the surface of the chemical agent retaining portions 36, subsequently, merges with the direct airflow of the air cooling blowers 1, and, in the portion of the collar 3, flows upwards along the face and the posterior of the neck and, in the portions of the sleeve openings 4, flows forward around the hands. In other words, the chemical agent, with which the chemical agent retaining portions 36 is impregnated, is blown out around the face and around the hands; accordingly, effect of exterminating the insect pests and repelling the insect pests is exerted.

Note that through holes 37 may be provided in the portions in the air-cooled clothing 2 where the chemical agent retaining portions 36 are provided so that a portion of the wind caused by the air cooling blowers 1 flowing inside the air-cooled clothing 2 is blown out through the through holes 37 increasing the carrying-out effect of the chemical agent from the chemical agent retaining portions 36. Furthermore, in terms of the effect of exterminating the insect pests and repelling the insect pests, the air cooling blowers 1 do not have to be attached to the air-cooled clothing 2 in an inclined state as in FIG. 6, and, specifically, the air cooling blowers 1 may be attached to the air-cooled clothing 2 in a horizontal state.

Third Embodiment

Figure 27:
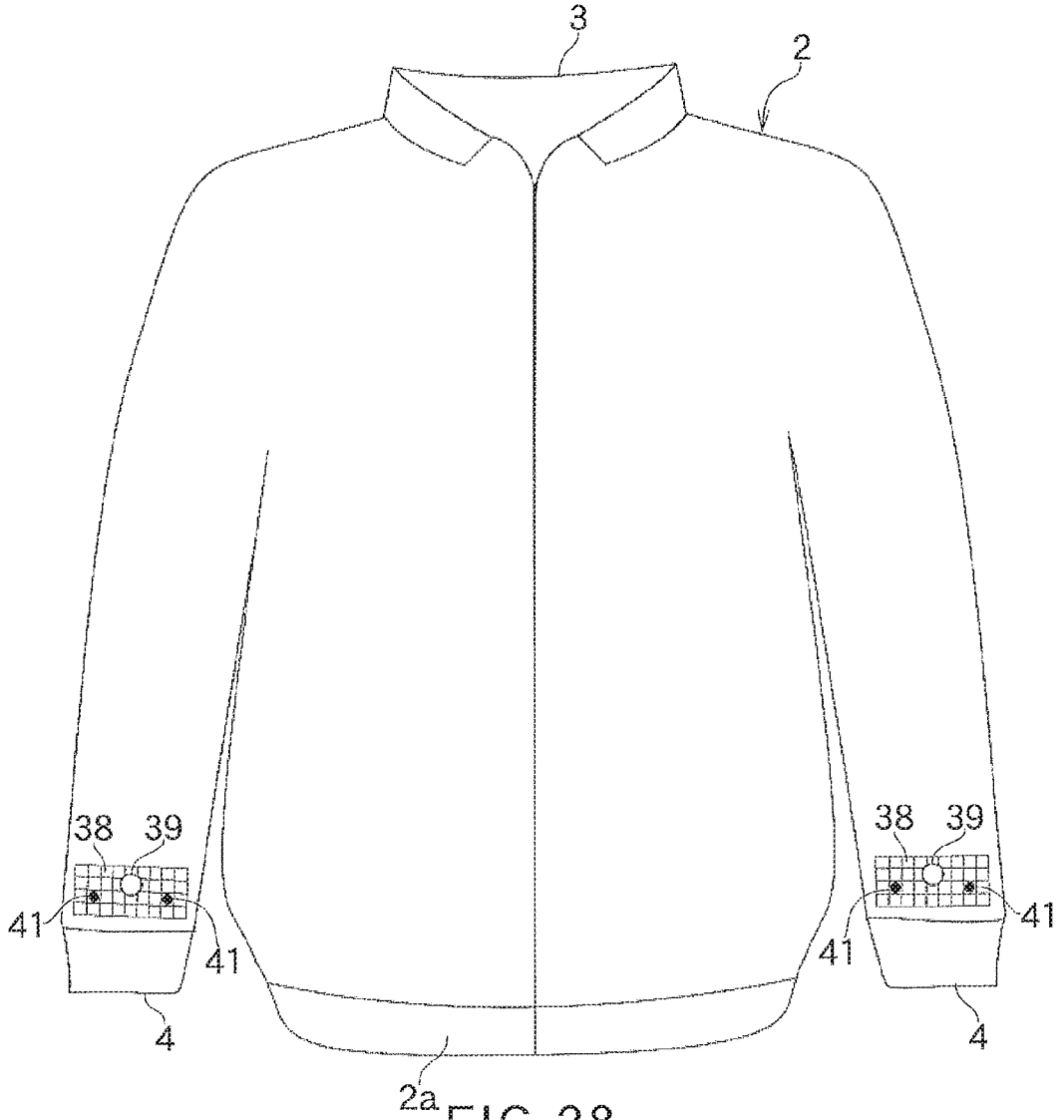
FIG. 27 is a front view of further another piece of air-cooled clothing on which the air cooling blowers according to an embodiment of the present invention are mounted.
Figure 28:
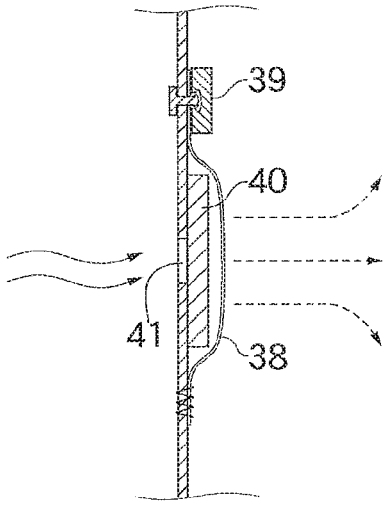
FIG. 28 is a partially enlarged view of the air-cooled clothing.
Figure 29:
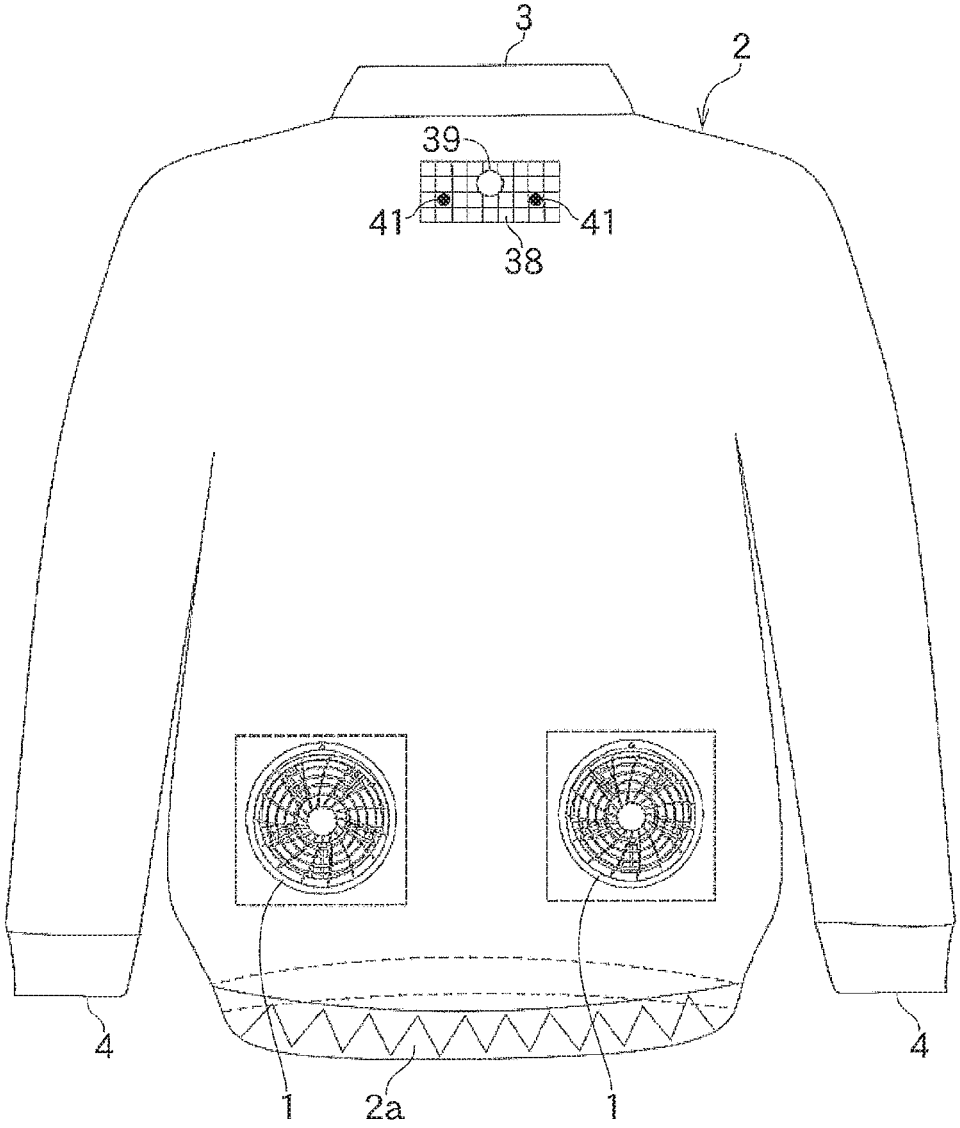
FIG. 29 is a rear view of the air-cooled clothing.

FIGS. 27 and 28 illustrate a state in which air cooling blowers 1 according to an embodiment of the present invention are further mounted on another piece of air-cooled clothing 2.

The air cooling blowers 1 used in the third embodiment have exactly the same configuration as that of the first embodiment; accordingly, in order to avoid complicating the description, description thereof is omitted. In other words, the configuration of the air cooling blowers 1 used in the embodiment has a configuration in FIGS. 5 to 24. A feature of the embodiment is that chemical agent retaining portions 38 aimed to exterminate insect pests (a mosquito, for example) and repel insect pest are provided in portions in the vicinity of the collar 3 and in the vicinity of the sleeve openings 4 of the air-cooled clothing 2.

Specifically, each chemical agent retaining portion 38 is, for example, bag shaped and has air permeability so that a button 39 can be taken off to form an opening and, for example, a solid chemical agent 40 (a pyrethroid chemical agent) can be retained. Furthermore, the chemical agent retaining portions 38 are provided on the outer surfaces of the air-cooled clothing 2, and are configured so as to be rarely in contact with the human body. In other words, the chemical agent retaining portions 38 are portions provided separately on the outer surfaces of the air-cooled clothing 2, and the outside air in the air cooling blowers 1 described above passes through the inside of the air-cooled clothing 2 and is blown out to the outside through the portions of the collar 3 and sleeve openings 4 of the air-cooled clothing 2.

Furthermore, by providing through holes 41 in portions of the air-cooled clothing 2 where the chemical agent retaining portions 38 are provided, a portion of the wind caused by the air cooling blowers 1 flowing inside the air-cooled clothing 2 is blown out through the through holes 41 and is made to flow along the surface of the chemical agents 40 retained inside a net-shaped chemical agent retaining portions 38. Subsequently, the component of the chemical agent is carried out to the outside of the chemical agent retaining portions 38. In other words, the chemical agent, with which the chemical agent retaining portions 38 is impregnated, is blown out around the face and around the hands; accordingly, effect of exterminating the insect pests and repelling the insect pests is exerted.

Furthermore, in terms of the effect of exterminating the insect pests and repelling the insect pests, the air cooling blowers 1 do not have to be attached to the air-cooled clothing 2 in an inclined state as in FIG. 6, and, specifically, the air cooling blowers 1 may be attached to the air-cooled clothing 2 in a horizontal state.

Fourth Embodiment

Figure 30:
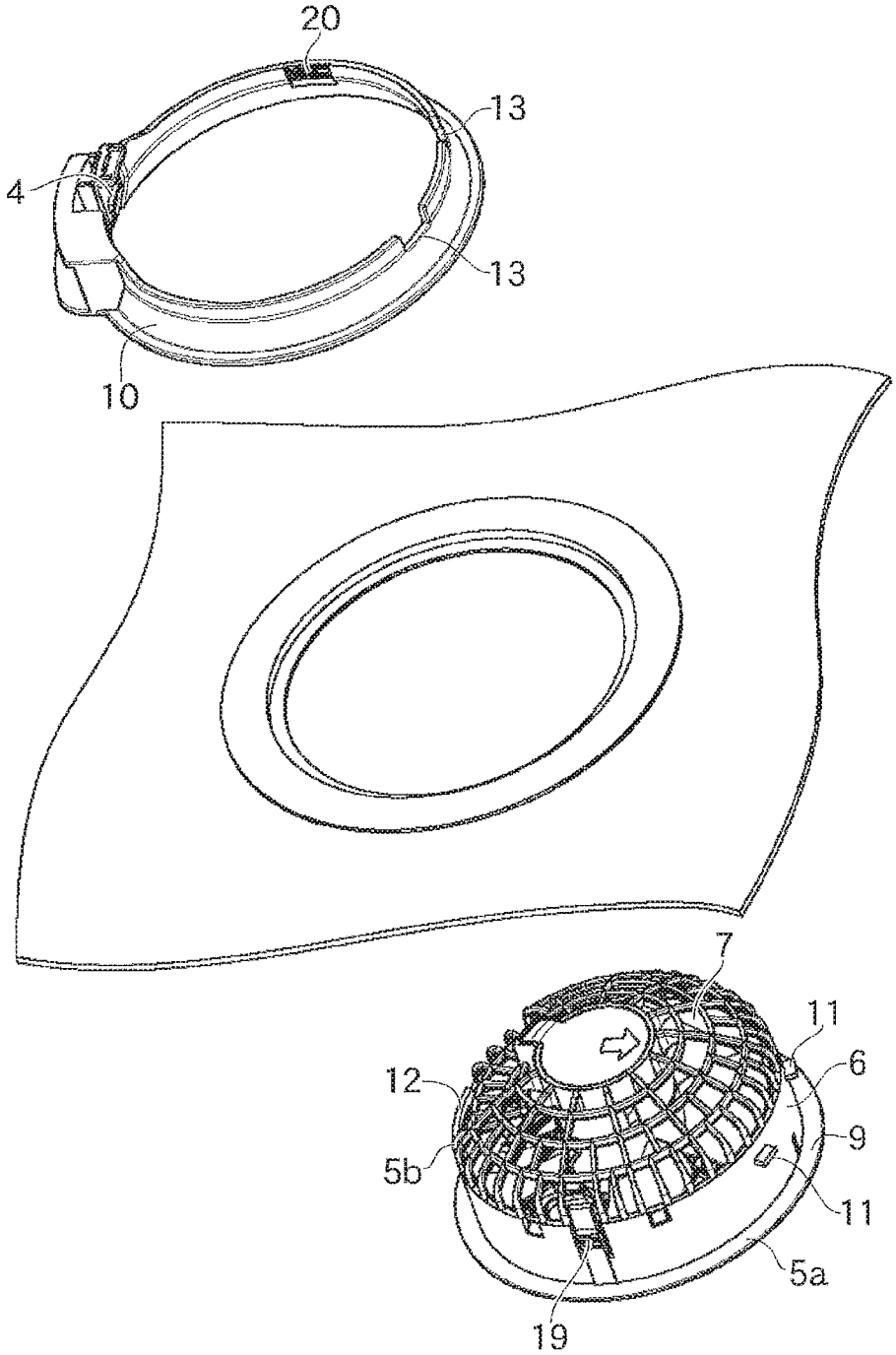
FIG. 30 is an exploded perspective view that illustrates another embodiment of the present invention.

FIG. 30 illustrates another embodiment of the present invention. In other words, in the embodiment in FIGS. 1 to 24, the mounting flange 9 is integrally formed from the outer peripheral wall portion of the tubular fan case 6 in the outer peripheral direction in the outer peripheral wall portion of the tubular fan case 6 between the air intake port 5*a* and the air outlet port 5*b* in an inclined state with respect to the central axis X of the tubular fan case 6. Conversely, in the one illustrated in FIG. 30, the mounting flange 9 is integrally formed on the air intake port 5*a* side in the outer peripheral wall portion of the tubular fan case 6 from the outer peripheral wall portion in the outer peripheral direction. In other words, in the present embodiment, the mounting flange 9 is in a horizontal state. However, even in one as above in which the mounting flange 9 is in a horizontal state as well, the first and second lock portions 11 and 12 are disposed so as to have a difference in positions in the longitudinal direction of the tubular fan case 6. In other words, the first lock portions 11 are disposed on the air intake port 5*a* side with respect to the second lock portion 12. In the present embodiment, the hook-shaped first lock portions 11 are provided in the portions of the mounting flange 9 or in the portions of the tubular fan case 6 near the portions of the mounting flange 9, and the through-hole-shaped second lock portion 12 is provided in the portion of the mounting flange 9 that opposes the first lock portions 11 via the central axis X of the tubular fan case 6 interposed therebetween or in the portion of the tubular fan case 6 near the portion of the mounting flange 9 that opposes the first lock portions 11 via the central axis X of the tubular fan case 6 interposed therebetween. The notch-shaped first engagement portions 13 are provided at the portions in the mounting ring 10 corresponding to the first lock portions 11, and the second engagement portion 14 is provided at the portion in the mounting ring 10 corresponding to the second lock portion 12. As described above, the first and second lock portions 11 and 12 are disposed in a state provided with a difference in positions in the longitudinal direction of the tubular fan case 6 (the first lock portions 11, disposed on the air intake port 5*a* side with respect to the second lock portion 12). Accordingly, in the present embodiment as well, when mounting the air cooling blower 1 on the air-cooled clothing 2, the air outlet port 5*b* of the air cooling blower 1 is first inserted into the through hole 15 of the air-cooled clothing 2 from the front side of the air-cooled clothing 2, and a surface of the mounting flange 9 on the air outlet port 5*b* side is abutted against an opening edge of the through hole 15 of the air-cooled clothing 2. Subsequently, the mounting ring 10 is fitted into the outer peripheral wall portion of the tubular fan case 6 from the back side of the air-cooled clothing 2 and is slid and moved towards the mounting flange 9 side. Then, the first lock portions 11 on the mounting flange 9 side and the first engagement portions 13 of the mounting ring 10 are abutted against each other and, here, the first lock portions 11 on the mounting flange 9 side and the first engagement portions 13 of the mounting ring 10 are engaged with each other. Subsequently, while the above portion serves as an axis, the second engagement portion 14 of the mounting ring 10 is slid and moved towards the second lock portion 12 on the mounting flange 9 side; accordingly, the air cooling blower 1 can be easily mounted on the air-cooled clothing 2 and becomes one with good usability. Furthermore, when cancelling the engagement between the mounting ring 10 and the mounting flange 9, while the portion of engagement between the first lock portions 11 on the mounting flange 9 side and the first engagement portions 13 of the mounting ring 10 serves as an axis, the second engagement portion 14 of the mounting ring 10 is to be pulled and detached from the second lock portion 12 on the mounting flange 9 side. Subsequently, by sliding the mounting ring 10 towards the air outlet port 5*b* side of the tubular fan case 6 and dismounting the mounting ring 10 from the tubular fan case 6, the air cooling blower 1 can be easily dismounted from the air-cooled clothing 2 and becomes one with good usability.

INDUSTRIAL APPLICABILITY

As described above, the present invention can be mounted on and dismounted from the air-cooled clothing easily and is extremely user friendly.

REFERENCE SIGNS LIST

1 air cooling blower
2 air-cooled clothing
2*a* narrowed portion
3 collar
4 sleeve opening
5*a* air intake port
5*b* air outlet port
6 tubular fan case
7 fan
8 motor
9 mounting flange
10 mounting ring
11 first lock portion
12 second lock portion
13 first engagement portion
14 second engagement portion
15 through hole
16 energizing portion
17 plug
18 through hole
19 first recessed and protruded portion
20 second recessed and protruded portion
21 air flow guide
22 motor attachment portion
23 first fitting reference mark
24 frame-shaped seam
25 corner
26 corner
27 drive circuit
28 battery
29 control circuit
30 input voltage detection circuit
31 booster circuit
32 output voltage detection circuit
33 comparison and amplification circuit
34 external case
35 second fitting reference mark
36 chemical agent retaining portion
37 through hole
38 chemical agent retaining portion
39 button
40 chemical agent
41 through hole
X central axis

The invention claimed is:

1. An air cooling blower comprising:

a tubular fan case including an air intake port on a first end side and an air outlet port on a second end side;

a fan provided inside the tubular fan case;

a motor that drives the fan;

a mounting flange protrusively formed in an outer peripheral wall portion of the tubular fan case in an outer peripheral direction; and a mounting ring that is engaged to the mounting flange at an outer peripheral portion of the tubular fan case, wherein a first lock portion is provided in a portion of the tubular fan case near a portion of the mounting flange, a second lock portion is provided in a portion of the tubular fan case near the portion of the mounting flange that opposes the first lock portion via a central axis of the tubular fan case interposed therebetween, a first engagement portion is provided in the mounting ring in a portion corresponding to the first lock portion, a second engagement portion is provided in the mounting ring in a portion corresponding to the second lock portion, and positions where the first lock portion and the second lock portion are disposed are displaced with respect to each other in a longitudinal direction of the tubular fan case, wherein when the first lock portion and the first engagement portion are engaged with each other, the engaged first lock portion and first engagement portion act together as an axis of rotation about which the mounting ring is rotated, such that the second engagement portion can slide and move over the air outlet port on the second end side of the tubular fan case towards the second lock portion, wherein a first alternately recessed and protruded portion which protrudes in the outer peripheral direction of the tubular fan case is provided between the air intake port on the first end side of the tubular fan case and the air outlet port on the second end side of the tubular fan case, wherein the first alternately recessed and protruded portion is provided in a portion of the tubular fan case between the first lock portion of the mounting flange and the second lock portion, wherein a second alternately recessed and protruded portion which protrudes from an inner side of the mounting ring is provided in a portion of the mounting ring that corresponds to the first alternately recessed and protruded portion of the tubular fan case, and wherein the first and second alternately recessed and protruded portions are each formed of a plurality of recesses and protrusions, such that the sliding becomes piecemeal through the recesses and protrusions, and the mounting flange and the mounting ring are engaged to each other at intervals corresponding to the number of recesses and protrusions.

2. The air cooling blower according to claim 1, wherein the mounting flange is formed on the outer peripheral wall portion of the tubular fan case between the air intake port and the air outlet port in an inclined state with respect to the central axis of the tubular fan case, and wherein the first lock portion is provided in the portion of the tubular fan case near the portion of the mounting flange, and the second lock portion is provided in the portion of the tubular fan case near the portion of the mounting flange that opposes the first lock portion via the central axis of the tubular fan case interposed therebetween.

3. The air cooling blower according to claim 1, wherein the first lock portion and the first engagement portion are provided in plural numbers.

4. The air cooling blower according to claim 1, wherein the second engagement portion of the mounting ring is integrated with the mounting ring at a portion of the mounting ring on the inlet port side of the tubular fan case, and is formed to extended, with respect to the mounting ring, from an integrated portion towards the air outlet port side of the tubular fan case.

5. The air cooling blower according to claim 1, wherein the mounting ring has a color that is lighter than that of the tubular fan case or the mounting flange.

6. The air cooling blower according to claim 5, wherein the mounting ring has a fluorescent color.

7. The air cooling blower according to claim 1, wherein an air flow guide is provided in the air outlet port of the tubular fan case, and a motor attachment portion to which the motor is attached is provided at a center portion of the air flow guide, and wherein a first fitting reference mark is provided on an outside portion of the tubular fan case of the motor attachment portion.

8. The air cooling blower according to claim 7, wherein a second fitting reference mark is provided in an outer peripheral portion of the mounting flange.

9. The air cooling blower according to claim 7, wherein a motor drive circuit of the motor is provided in the motor attachment portion.

10. The air cooling blower according to claim 9, wherein the drive circuit of the motor outputs a motor drive voltage proportionate to an input voltage.

11. Air-cooled clothing comprising the air cooling blower according to claim 1.

12. The air cooling blower according to claim 2, wherein the first lock portion and the first engagement portion are provided in plural numbers.

* * * * *